US005557362A

United States Patent [19]

Ueda

[11] Patent Number: 5,557,362

[45] Date of Patent: Sep. 17, 1996

[54] SILVER HALIDE PHOTOSENSITIVE MATERIAL AUTOMATIC DEVELOPING APPARATUS

[75] Inventor: Yutaka Ueda, Hino, Japan

[73] Assignee: Konica Corporation, Tokyo, Japan

[21] Appl. No.: 489,381

[22] Filed: Jun. 12, 1995

[30] Foreign Application Priority Data

Jun. 16, 1994 [JP] Japan ..... 6-13474

[51] Int. Cl.[6] ..... G03D 3/02

[52] U.S. Cl. ..... 354/324

[58] Field of Search ..... 354/299, 324, 354/325, 331, 336; 430/393, 398–400, 450, 455, 465, 30

[56] References Cited

U.S. PATENT DOCUMENTS

| | | | |
|---|---|---|---|
| 5,102,778 | 4/1992 | Nakamura | 430/393 |
| 5,380,626 | 1/1995 | Nakamura et al. | 430/393 |
| 5,400,105 | 3/1995 | Koboshi et al. | 354/324 |

FOREIGN PATENT DOCUMENTS

| | | |
|---|---|---|
| 0595312A1 | 5/1994 | European Pat. Off. . |
| 0607912A3 | 7/1994 | European Pat. Off. . |
| WO91/12567 | 8/1991 | WIPO . |

OTHER PUBLICATIONS

Patent Abstracts of Japan, vol. 18, No. 228 (P–1730), (1994) of JP–A–06 019013.

*Primary Examiner*—D. Rutledge

*Attorney, Agent, or Firm*—Frishauf, Holtz, Goodman, Langer & Chick, P.C.

[57] ABSTRACT

In an apparatus for processing a silver halide color photographic material, a ratio of a unit amount A of a solid agent to be replenished at a time to the volume B of a color developing solution in a color developing tank satisfies the following relation: A/B<5, and a conveyor conveys the photographic material from starting dipping the photographic material in the color developing solution to starting dipping the photographic material in a processing solution for a time not longer than 18 seconds.

19 Claims, 14 Drawing Sheets

SILVER HALIDE PHOTOSENSITIVE MATERIAL AUTOMATIC DEVELOPING APPARATUS

BACKGROUND OF THE INVENTION

The present invention relates to a silver halide photosensitive material automatic developing apparatus.

Conventionally, silver halide photosensitive material is processed in a processing solution by an automatic developing apparatus. It is common that the processing agent is replenished into the processing tank so as to maintain the activity of the processing solution in the processing tank at a predetermined value. Conventionally, the following replenishing system is employed to replenish the processing agent into the processing tank. The processing agent is previously dissolved. The thus obtained replenishing solution is supplied into the processing tank. This method is commonly used.

However, according to this commonly used replenishing method, the following problems may be encountered. When the color development replenishing solution stays in a color development replenishing solution tank over a long period of time, the color developing agent is necessarily oxidized. When the oxide of a color developing agent is deposited on the photosensitive material, the quality of a developed image is deteriorated in a low density portion on the photosensitive material, especially in a white portion on a photographic paper.

In order to avoid a long stay of the color development replenishing solution in the color development replenishing solution tank, a method has been disclosed recently by Japanese Patent Publication Open to Public Inspection No. 11954/1993, in which the processing agent for processing silver halide photosensitive material is solidified, and the solid processing agent is directly supplied into the processing tank so that the components of the processing agent can be replenished.

However, the present inventors have found that the following problems may be encountered even when the above method is used, in which the solid processing agent is directly supplied into the processing tank.

When an amount of photosensitive material to be processed in one day is too small, the color developing solution in the processing tank is not replaced with a new one. Accordingly, the color developing agent in the solution filled in the color developing tank is necessarily oxidized. As a result, the oxide of the developing agent is deposited on the photosensitive material. When the oxide of a color developing agent is deposited on the photosensitive material, the quality of a developed image is deteriorated in a low density portion on the photosensitive material, especially in a white portion on a photographic paper.

In Japanese Patent Publication Open to Public Inspection No. 119454/1993 described before, there is no description of the above problems, much less a specific method to solve the problems.

It is an object of the present invention to solve the problem in which the oxide of the color developing agent is deposited on the photosensitive material and the quality of an image formed in a low density portion of the photosensitive material is deteriorated.

SUMMARY OF THE INVENTION

Another object of the present invention is to suppress a change in the solution level so as to prevent the precipitation of the processing agent component and the deterioration of the processing solution.

It is possible to accomplish the above objects by the apparatus described in claim of the, present invention.

The above object can be accomplished by an automatic developing apparatus for processing silver halide color photosensitive material including a mechanism for supplying a solid processing agent for color development use substantially directly into a color development tank in the case of replenishing the solid processing agent, wherein the color development processing time is not more than 18 seconds.

The above object can be accomplished by an automatic developing apparatus for processing silver halide color photosensitive material including a mechanism for supplying replenishment water substantially directly into a color development tank in the case of replenishing the replenishment water, and also including a mechanism for supplying a solid processing agent for color development use substantially directly into a color development tank in the case of replenishing the solid processing agent, wherein the color development processing time is not more than 18 seconds.

In this case, it is preferable that the replenishment water substantially directly replenished into the color development tank is heated.

In this case, it is preferable that a ratio A/B satisfies the following inequality.

$$A/B<5$$

where A is a unit supply amount (g) of the solid processing agent for color development use per one operation, and B is a tank capacity (l) of the color development tank.

It is preferable that an opening area ratio N of the above color development tank is not more than 12 $cm^2/l$.

In this case, the opening area ratio N is defined as a ratio S/B, wherein S is an opening area ($cm^2$) which is an interface area of gas and liquid in the color processing tank, and B is a tank capacity (l) of the color processing tank.

It is preferable to provide nozzles for jetting the color development processing solution onto a photosensitive surface of the silver halide photosensitive material passing in the color development tank.

It is preferable that the following inequality is satisfied.

$$B/C<100$$

where B is a tank capacity (l) of the color development tank, and C is an amount (l) of water replenished for dissolving the replenishment solid processing agent which is replenished for 1 $m^2$ of silver halide photosensitive material.

It is preferable that a shape of the color development tank is formed in accordance with a conveyance passage of silver halide photosensitive material.

It is preferable that a portion of the inner wall of the color development tank is also used as a conveyance guide for guiding the silver halide photosensitive material.

It is preferable that the automatic developing apparatus includes a processing solution circulation means for generating a circulation current in the color development tank, wherein a flow rate of the circulation current generated by the processing solution circulation means is variable.

It is preferable that a filter is provided in the circulation passage in which the processing solution is circulated so that the processing solution is subjected to filtration, and the solid processing agent for color development use is supplied before the filter through which the processing solution is circulated.

The above object can be accomplished by an automatic developing apparatus for silver halide photosensitive material including: a processing tank, the shape of which is formed in accordance with the conveyance passage of photosensitive material; and a filter arranged in a circulation passage in which the processing solution is circulated so as to conduct filtration of the processing solution, the automatic developing apparatus further including a first circulation means arranged in the circulation passage between the processing tank and the filter, and a second circulation means arranged in the circulation passage between the filter and the processing tank.

It is preferable to provide a nozzle means at a discharge port of the second circulation means on the processing tank side.

It is preferable that a flow rate of the circulation current generated by the second circulation means is substantially constant in the processing of photosensitive material.

It is preferable to provide a processing tank solution level detecting means and to control the first circulation means in accordance with the result of detection of the processing tank solution level detecting means.

It is preferable that a flow rate of the circulation current generated by the second circulation means is variable according to the circumstances and the first circulation means is also controlled according to the circumstances.

It is preferable to provide a processing tank solution level detecting means and to control the first or second circulation means in accordance with the result of detection of the processing tank solution level detecting means.

The above object can be accomplished by an automatic developing apparatus for silver halide photosensitive material including a filter arranged in a circulation passage in which a color development solution, the developing time of which is not more than 18 seconds, is circulated so that the processing solution is subjected to filtration, the automatic developing apparatus further including a first circulation means provided in the circulation passage between the color development tank and the filter, and a second circulation means provided in the circulation passage between the filter and the color development tank.

The present invention is different from the conventional trend of technology in which only the oxidization of the color developing agent is prevented. The concept of the present invention is to prevent not only the oxidization of the color developing agent but also the deposition of the oxide of the color developing agent. According to the present invention, an automatic developing apparatus for developing silver halide color photosensitive material comprises a solid processing agent supply mechanism for directly supplying the color solid processing agent into a color developing tank, wherein an amount of deposition of the oxide of the color developing agent is reduced when the color developing time is not more than 18 seconds even if the throughput of photosensitive material per one day is small.

In this case, it is preferable that the apparatus is provided with a mechanism for substantially directly replenishing the replenishment water into the color developing tank. In this case, it is preferable that the replenishment water directly replenished into the color developing tank is heated. When the replenishment water is heated, it is possible to maintain the stability of of the temperature of the solution in the color developing tank. As a result, it is possible to stabilize development.

Further, the present inventors have found the following. Character A (g) is defined as an amount of supply of the color developing solid processing agent per one operation, and character B (l) is defined as a tank capacity of the color developing processing tank. When the inequality of $0.01<A/B<5$ is satisfied, development processing can be carried out stably even when the color developing time is not more than 18 seconds. Specifically, when the color developing time exceeds 18 seconds, the color development characteristic is stable with respect to the fluctuation of the concentration of the color developing agent, however, when the color developing time is not more than 18 seconds, the color development characteristic becomes unstable with respect to the fluctuation of the concentration of the color developing agent, and the fluctuation of the concentration of the color developing agent is small when the inequality of $0.01<A/B<5$ is satisfied. It is preferable that the inequality of $0.05<A/B\leqq 3$ is satisfied in order to easily reduce the fluctuation of the color developing agent concentration. In this case, the tank capacity is defined as a volume of the processing solution in the processing tank in the ordinary processing operation. That is, the tank capacity includes not only the processing solution in the processing tank but also the processing solution in an auxiliary tank or a circulation pipe.

In order to completely generate a color developing reaction, it is preferable that the color developing time is not less than 5 seconds.

In order to prevent the oxidization of the color developing agent in the color developing tank so that the deterioration of image quality can be prevented, it is preferable that an opening area ratio N of the color developing tank is not less than 0.5 $cm^2/l$ and not more than 12 $cm^2/l$. It is more preferable than the opening area ratio N is not less than 1.0 $cm^2/2$ and not more than 8 $cm^2/2$. In this case, the opening area ratio N is defined as a ratio S/B of the opening area S $cm^2$, which is an interface area of gas and liquid of the color processing tank, to the tank capacity B (l) of the color processing tank.

When there is provided a nozzle for spraying the color development processing solution on a surface of the silver halide color photosensitive material passing in the color developing tank, the color developing agent permeates into the photosensitive material, and the development processing is carried out stably. In this case, the nozzle configuration may be a spot type or slit type. Also, it is preferable to provide a processing solution circulation means for generating a circulating current in the color developing tank so that the color development processing solution can be supplied to the nozzle by this processing solution circulation means.

In order to accomplish the color development in the developing time of not more than 18 seconds, it is necessary to increase the concentration of the color developing agent in the color developing tank. Accordingly, the color developing agent is apt to oxidize. In this case, the tank capacity of the color developing tank is defined as B (l), and an amount of water replenished for dissolving the solid processing agent for replenishment per 1 $m^2$ of silver halide color photosensitive material is defined as C (l). When the ratio B/C is high like a conventional developing tank, a processing agent renewal ratio, which is a ratio of the color development processing agent renewed each time a unit area of photosensitive material is processed, is low, so that the oxide of the color developing agent tends to accumulate. However, when the inequality of $1.5<B/C<100$ is satisfied, the processing agent renewal ratio becomes high. Therefore, the oxide of the color developing agent is difficult to accumulate. The more preferable range of the ratio B/C is 3 to 50.

When the configuration of the processing tank is formed in accordance with the conveyance passage of photosensitive material, the processing solution is in existence only in a portion close to the conveyance passage. Therefore, it is possible to reduce the tank capacity of the color developing tank. In this case, when a portion of the inner wall of the color developing tank is also used as a conveyance guide of silver halide color photosensitive material, the tank capacity of the color developing tank is further reduced. In this case, even though an exclusive guide is not provided, silver halide color photosensitive material can be smoothly conveyed in the apparatus. Further, the occurrence of jam of silver halide color photosensitive material is prevented, and the oxidization of the color developing solution caused in the process of jam clearance can be prevented. When the configuration of the processing tank is formed in accordance with the conveyance passage of photosensitive material, the ratio of B/ST can be preferably maintained to be not less than 1.5 and not more than 100, wherein ST ($m^2$) is the area of photosensitive material conveying surface in the processing tank, and B (l) is a tank capacity. More preferably, the ratio of B/ST is not less than 3.0 and not more than 50. In this case, when a portion of the inner wall of the color developing tank is also used as a conveyance guide of silver halide color photosensitive material, the tank capacity of the color developing tank is further reduced. In this case, even though an exclusive guide is not provided, silver halide color photosensitive material can be smoothly conveyed in the apparatus. Further, the occurrence of jam of silver halide color photosensitive material is prevented, and the oxidization of the color developing solution caused in the process of jam clearance can be prevented.

The apparatus of the invention includes a processing solution circulating means for generating a circulating current in the color developing tank. A magnetic pump, a rotating means with a propeller screw and like can be used as the processing solution circulating means in the present invention. An amount of circulating current generated by this processing solution circulating means is variable in accordance with the operation of the automatic developing apparatus. Due to the foregoing, while the photosensitive material is processed in the color developing tank, an amount of the generated circulating current is increased so that the development property can be enhanced. While the photosensitive material is not processed in the color developing tank, that is, while the solid processing agent or replenishment water is supplied, a small amount of circulating current is circulated so that the oxidization of the color developing agent can not advance. Due to the foregoing, the occurrence of uneven density on a developed image can be prevented. As a specific method for generating a circulating current, the amount of which is variable, a propeller type type pump, the propeller speed of which is variable, is proposed.

In the apparatus of the invention, a filter is provided in the circulating passage in which the processing solution is circulated. The processing solution is subjected to filtration by this filter. It is preferable that the solid processing agent for color development use is supplied at a position before the filter provided in the circulating passage. In other words, it is preferable that the solid processing agent is supplied upstream of the located position of the filter in relation to the flow direction of the processing solution.

It is possible to use the mechanism of the present invention for the bleaching, fixing, bleaching and fixing and stabilizing processes.

Also, the present invention is to provide a silver halide photosensitive material automatic developing apparatus in which the configuration of the processing tank is formed in accordance with the conveyance passage of photosensitive material and a filter is provided in the circulating passage so that the processing agent is subjected to filtration. In this automatic developing apparatus, there are provided a first circulating means in the circulating passage between the processing tank and the filter, and a second circulating means in the circulating passage between the filter and the processing tank. Due to the foregoing structure, even when the circulating current flows at high speed, a pressure loss caused by the filter and the processing tank is compensated by the first and second circulating means. Accordingly, there is no difference between a solution level in the case of a circulating current of high speed and a solution level in the case of no circulating current. Consequently, it is possible to prevent the processing tank from overflowing. Also, it is possible to prevent the solution level from being greatly lowered. Therefore, the precipitation of the processing agent component and the deterioration of the solid solution, which are caused by the fluctuation of the solution level, can be prevented.

This technique is effective. The reason is described as follows. When the nozzle means is provided at an outlet on the processing tank side of the second circulating means, a pressure loss generated in the processing tank is large since the flow speed of the processing solution is high in the processing tank.

In order to stabilize the processing of photosensitive material, it is very effective that a rate of flow of the circulating current generated by the second circulating means is substantially constant. It is very effective especially in the case of color development in which the color development processing time is not more than 18 seconds. In the case where a rate of flow of the circulating current generated by the second circulating means is substantially constant, when a processing tank solution level detecting means is provided in the processing tank, the first circulating means is controlled in accordance with the result of detection of the processing tank solution level detecting means. In this way, while the processing solution level is maintained constant, the rate of flow of the circulating current can be made to be substantially constant. Accordingly, the processing of photosensitive material can be more stabilized. Further, a rate of flow of the circulating current generated by the second circulating means is variable in accordance with the circumstances, and the first circulating means is controlled in accordance with the circumstances. In this way, the first circulating means is subjected to not only feedback control but also feed forward control. Therefore, it is possible to further stabilize the processing tank solution level.

As described above, when the processing tank solution level detecting means is provided in the processing tank, the solution level is detected by this means. In accordance with the result of detection, the first or second circulating means is controlled, so that the processing tank solution level can be stabilized.

In a silver halide color photosensitive material automatic developing apparatus in which the color developing time is not more than 18 seconds, there is provided a filter in the color developing solution passage so that the processing solution is subjected to filtration. In this silver halide color photosensitive material automatic developing apparatus, the first circulating means is provided in the circulating passage from the color developing tank to the filter, and the second circulating means is provided in the circulating passage from the filter to the color developing tank. In the above automatic developing apparatus, even when a flow speed of the circulating current is high, since a pressure loss generated in the filter and processing tank is compensated by the first and second circulating means, a difference of the solution level is not caused between a case in which the circulating current flows at high speed and a case in which the circulating current does not flow. Consequently, it is possible to prevent the processing tank from overflowing. Also, it is possible to prevent the solution level from being greatly lowered. Therefore, the precipitation of the processing agent component and the deterioration of the solid solution, which are caused by the fluctuation of the solution level, can be prevented.

In the present invention, the solid processing agent is defined as a solid processing agent used for replenishing the processing agent components of the color developing solution. Various types solid processing agents are used. Examples of usable solid processing agents are powdery, tablet-shaped, pill-shaped, and granular solid processing agents. When necessary, the surface of the solid processing agent may be coated with a water soluble polymer. In the present invention, powder is defined as an aggregated body composed of minute crystals. In the present invention, granules are defined as particles made of powder, and it is preferable that the particles size is 50 to 5000 μm. In the present invention, a tablet is defined as a piece in which powder or granules are molded into a predetermined shape by means of compression. In the present invention, a pill is defined as a piece in which powder or granules are formed into a spherical shape by means of granulation or making tablet. It is preferable to use a granular, tablet-shaped or pill-shaped solid processing agent because it is not dusty and further the charging accuracy of the solid processing agent can be enhanced. Especially, the tablet type solid processing agent is most preferable because it is handy and the replenishment accuracy is high. Further, the tablet type solid processing agent is not dissolved suddenly, so that the concentration is not changed abruptly. Therefore, the effects of the present invention can be completely provided.

In order to solidify the photographic processing agent, arbitrary means may be employed. For example, a thick solution, fine powder or minute particles are mixed with a water soluble binder and then kneaded and molded. Alternatively, the surface of a temporarily formed solid photographic processing agent is coated with a water soluble binder by means of atomization. These means are disclosed in Japanese Patent Publication Open to Public Inspection Nos. 29136/1992, 85533/1992 to 85536/1992 and 172341/1992.

A preferable method of manufacturing tablets is to form a powdery solid processing agent into granules and then the granules are subjected to the process of making tablet. The thus obtained solid processing agent is superior to a solid processing agent made by mixing the solid processing agent components and forming them into a tablet, and further it is possible to provide a stable photographic performance. In this case, various granulation methods may be employed for making tablets, granules and pills. Examples of the usable methods are: rolling granulation, extrusion granulation, compression granulation, crushing granulation, agitation granulation, fluid bed granulation, and atomization drying granulation. When a water soluble binder is added by 0.01 to 20 weight percent in the process of granulation, a higher effect can be provided. Examples of the usable water soluble binders are: cellulose, dextrin, sugar-alcohol, polyethylene glycol, and cyclodextrin.

When the thus obtained granules are compressed to form a tablet, a compressor of the prior art can be used. Examples of the usable compressors are: a hydraulic press, single shot tablet making machine, rotary tablet making machine, and briquetting machine. More preferably, in the process of granulation, each component such as an alkali agent or preserving agent is separately subjected to granulation. Due to the foregoing, the above effect can be further enhanced.

The tablet processing agent can be manufactured by the common method disclosed in Japanese Patent Publication Open to Public Inspection Nos. 61837/1976, 155038/1979 and 88025/1977, and also disclosed in British Patent Publication No. 1,213,808. The granular processing agent can be manufactured by the common method disclosed in Japanese Patent Publication Open to Public Inspection Nos. 109042/1990, 109043/1990, 39735/1991 and 39739/1991. The powder processing agent can be manufactured by the common method disclosed in Japanese Patent Publication Open to Public Inspection No. 133332/1979 and British Patent Publication Nos. 725,892 and 729,862, and Germany Patent Publication No. 3,733,861.

In the present invention, the following supply methods for supplying the solid processing agent into the processing tank are used. When the solid processing agent is of a tablet type, the methods disclosed in Japanese Utility Model Publication Open to Public Inspection Nos. 137783/1988, 97522/1988 and 85732/1989. As long as the method is provided with a function to supply tablets into the processing tank, any method can be employed. In the case where the solid processing agent is of a granule or powder type, the gravity dropping method may be employed which is disclosed in Japanese Utility Model Publication Open to Public Inspection Nos. 81964/1987 and 84151/1988 and Japanese Patent Publication Open to Public Inspection No. 292375/1989, or alternatively the screw method may be employed which is disclosed in Japanese Utility Model Publication Open to Public Inspection Nos. 105159/1988 and 195345/1988. However, it should be noted that the present invention is not limited to the specific method.

According to the present invention, the solid processing agent is charged into any portion in the processing tank, however, it is preferable that the solid processing agent is charged into a portion communicated with the processing section in which the photosensitive material is processed and the processing solution is circulated between the portion and the processing section. It is also preferable that a predetermined amount of processing solution is circulated in the portion. It is also preferable that the solid processing agent is charged into a processing solution, the temperature of which is controlled.

From the view point of enhancing the effect of the present invention, and also from the view point of enhancing the durability and accuracy of the apparatus, an amount of the solid processing agent charged by one operation is preferably not less than 0.1 g. From the view point of enhancing the effect of the present invention, and also from the viewpoint of reducing the dissolving time, the amount of the solid processing agent charged by one operation is preferably not more than 50 g.

In the present invention, replenishment water is defined as water supplied into the processing tank in accordance with the throughput of the photosensitive material. In the present invention, replenishment water does not substantially include water to be supplied so as to make up for evaporated water. Consequently, in the present invention, an amount of added water for replenishment is an amount of water obtained when an amount of evaporated water is subtracted from a total amount of water supplied to the processing tank.

When the amount of added water for replenishment is not less than 30 ml per 1 $m^2$ of the photosensitive material, a solution level of the processing tank of the automatic developing apparatus is difficult to be lowered. Therefore, it is possible to provide a necessary processing time, so that the photographic performance is not affected, and the precipitation of unnecessary components in the processing solution is reduced and further the photosensitive material is not stained, which is preferable. On the other hand, when the amount of added water for replenishment is not more than 75 $ml/m^2$, an amount of waste solution is reduced as compared with a case in which the conventional replenishment system is employed. Therefore, environmental pollution is greatly reduced. Further, in comparison with the conventional replenishment system, the processing stability can be increased in the replenishment system of the present invention. In this case, it is preferable that the amount of replenishment water is not less than 35 $ml/m^2$, and it is more preferable that the amount of replenishment water is not less than 40 $ml/m^2$. It is also preferable that the amount of replenishment water is not more than 70 $ml/m^2$, and it is more preferable that the amount of replenishment water is not more than 60 $ml/m^2$.

An object of the present invention can be accomplished when an amount of replenishment of the developing agent of paraphenylene diamine contained in the solid processing agent is maintained so that a ratio of the amount of replenishment of the developing agent to an amount of replenishment water can be 0.024 mol/l to 0.066 mol/l. It is preferable that the above range is 0.028 mol/l to 0.062 mol/l. It is more preferable that the above range is 0.033 mol/l to 0.048 mol/l. When the ratio is maintained in the above range, remarkable effects can be provided by the present invention. That is, when the ratio is higher than the lower limit of the above range, while a sufficiently high photographic density is provided, an amount of replenishment water can be produced and also an amount of the waste solution can be reduced, which is preferable. On the other hand, when the ratio is lower than the upper limit of the above range, the concentration of the processing solution is not increased too high, so that the solubility of the color developing agent of paraphenylene diamine is not increased to a value close to the limit, and the occurrence of precipitation can be prevented, which is preferable.

The color developing agent of the present invention is a chemical compound of p-phenylene diamine having a water soluble group. At least one water soluble group is attached to the amino group of p-phenylene diamine compound or attached onto the benzene nucleus. Specific examples of the water soluble group are: $—(CH_2)_n—CH_2OH$, $—(CH_2)_m—NHSO_2—(CH_2)_nCH_3$, $—(CH_2)_m—O—(CH_2)_n—CH_3$, $—(CH_2CH_2O)_nC_mH_{2m+1}$ (m and n are integers not less than 0), —COOH and $—SO_3H$.

Specific examples of the chemical compounds of the color developing agent preferably used in the present invention are described in the following (C-1) to (C-18).

[Exemplary Color Developing Agent]

(C-1)

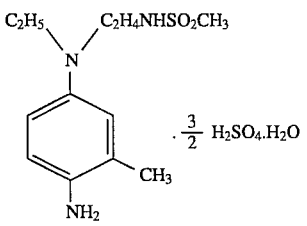

-continued

[Exemplary Color Developing Agent]

(C-2)

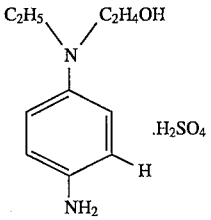

(C-3)

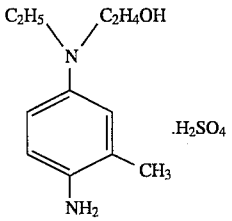

(C-4)

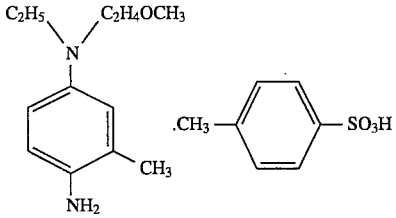

(C-5)

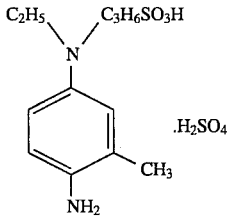

(C-6)

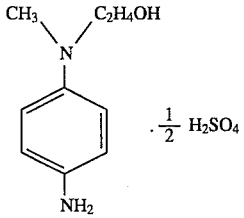

(C-7)

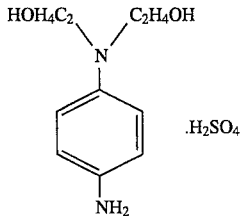

(C-8)

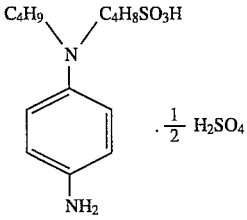

-continued

[Exemplary Color Developing Agent]

(C-9)

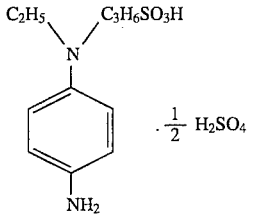

(C-10)

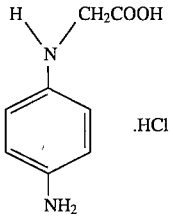

(C-11)

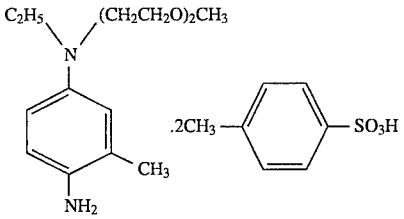

(C-12)

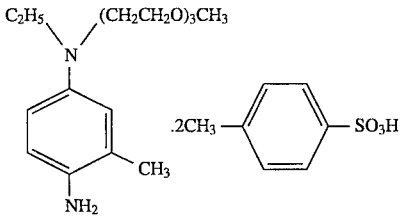

(C-13)

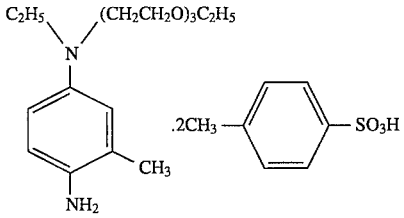

(C-14)

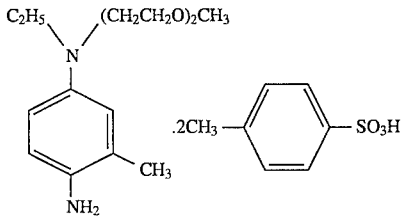

(C-15)

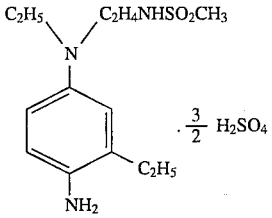

-continued

[Exemplary Color Developing Agent]

(C-16)

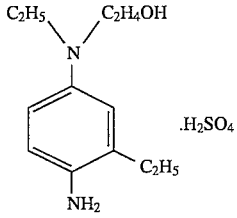

(C-17)

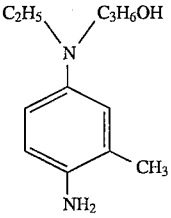

(C-18)

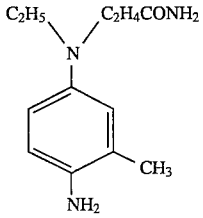

The following chemical compounds are preferably used in the present invention.

(C-1), (C-2), (C-3), (C-4), (C-15), (C-17), and (C-18).

A preferably used color developing agent capable of providing a remarkable effect of the present invention is the color developing agent of paraphenylene diamine having a water soluble group expressed by the following formula [I].

Formula [I]

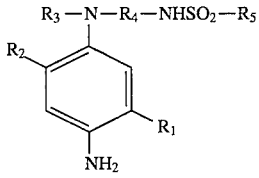

In the formula [I], $R_1$ and $R_2$ are an hydrogen atom, halogen, alkyl group, alkoxy group or acyl amino group. R3 is an alkyl group. R4 is an alkylene group. R5 is a substituted or unsubstituted alkyl group or aryl group.

Except for the chemical compounds described above, the following chemical compounds (C-19) to (C-35) are preferably used. These chemical compounds are expressed by the groups of $R_1$ to $R_5$ of the formula [I].

| | $R_1$ | $R_2$ | $R_3$ | $R_4$ | $R_5$ |
|---|---|---|---|---|---|
| C-19 | —H | —H | —$C_3H_7$ | —$CH_2CH$(—$CH_3$)— | —$CH_3$ |
| C-20 | —$NHCOCH_3$ | —H | —$CH_3$ | —$CH_2CH_2$— | —$CH_3$ |
| C-21 | —H | —H | —$CH_3$ | —$CH_2CH$(—$CH_3$)— | —$CH_3$ |
| C-22 | —$CH_2CH_3$ | —H | —$CH_3$ | —$CH_2CH_2$— | —$CH_3$ |
| C-23 | —$CH_3$ | —H | —$CH_3$ | —$CH_2CH$(—$CH_3$)— | —$CH_2CH_3$ |
| C-24 | —$CH_3$ | —H | —$CH_3$ | —$CH_2CH_2$— | —$CH_2CH_3$ |
| C-25 | —O—$CH_2CH_3$ | —H | —$CH_2CH_3$ | —CH(—$CH_3$)$CH_2$— | —$CH_3$ |
| C-26 | —$NHCOCH_3$ | —H | —$C_3H_7$ | —$CH_2CH_2$— | —$CH_3$ |
| C-27 | —$CH_3$ | —H | —$CH_2CH_3$ | —$CH_2CH_2$— | —$CH_2$—O—$CH_3$ |
| C-28 | —H | —H | —$CH_3$ | —$CH_2CH_2$— | —$CH_2$—N—$(CH_3)_2$ |
| C-29 | —$CH_3$ | —H | —$CH_2CH_3$ | —$CH_2CH_2$— | —$CH_2Cl$ |
| C-30 | —$CH_3$ | —H | —$CH_2CH_3$ | —$CH_2CH_2$— | —$CH_2$—NHCO—$CH_3$ |
| C-31 | —$CH_2CH_3$ | —H | —$CH_2CH_3$ | —$CH_2CH_2$— | —$CH_2$—O—$CH_3$ |
| C-32 | —$CH_3$ | —H | —$CH_2CH_3$ | —$CH_2CH_2$— | —$CH_2$—O—$CH_2CH_3$ |
| C-33 | —$CH_3$ | —H | —$CH_2CH_3$ | —$CH_2CH_2CH_2$— | —$CH_3$ |
| C-34 | —Cl | —H | —$CH_3$ | —$CH_2CH_2CH_2$— | —$CH_3$ |
| C-35 | —O—$CH_3$ | —H | —$CH_2CH_3$ | —$CH_2CH$(—$CH_3$)— | —$CH_3$ |

Chemical compounds of (C-20), (C-27), (C-29), (C-30) and (C-33) are preferably used. The most preferable chemical compound is (C-1) in the exemplary chemical compounds. In order to synthesize the chemical compounds of the formula [I], a synthesizing method described in Japanese Patent Publication Open to Public Inspection No. 37198/1992 may be employed. Commonly, the above developing agents are used in the form of hydrochloride, sulfate or p-toluene sulfonate.

The above color developing agent may be singly used, or alternatively two of them may be used together. When necessary, the monochromatic developing agents such as phenidone, 4-hydroxymethyl-4-methyl-1-phenyl-3-pyrazolidone and Metol may be used together.

When the chemical compound expressed by the following formula [A] or [B] is contained in the color developing agent of the present invention, the effect of the present invention is further enhanced. That is, when the developing agent is solidified, the preserving property can be enhanced higher than other chemical compounds. Further, the developing agent is stable from the viewpoint of the photographic performance. Therefore, the occurrence of fog is reduced in a portion that has not been exposed to light.

Formula [A]

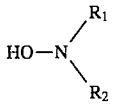

In the formula [A], $R_1$ and $R_2$ are alkyl groups, aryl groups, R'—CO— groups or hydrogen atoms, wherein hydrogen atoms are not used simultaneously. The alkyl groups expressed by $R_1$ and $R_2$ may be the same or different from each other, and it is preferable that each is an alkyl group, the carbon number of which is 1 to 3. Further, these alkyl groups may have a carboxylic acid group, a phosphoric acid group, a sulfonic acid group or hydroxyl group. In this case, R' expresses an alkoxy group, alkyl group or aryl group. The alkyl group and the aryl group of $R_1$, $R_2$ and R' include a substituent, and also $R_1$ and $R_2$ may be combined so as to be formed into an ring. For example, a heterocyclic ring such as piperidine, pyridine, triazine and morpholine may be composed.

Formula [B]

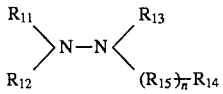

In the formula [B], $R_{11}$, $R_{12}$ and $R_{13}$ are hydrogen atoms, alkyl groups, aryl groups, or hetero cycle groups, wherein alkyl groups, aryl groups, and hetero ring groups are substituted or unsubstituted. $R_{14}$ is a hydroxy group, hydroxyamino group, alkyl group, aryl group, hetero-ring group, alkoxy group, aryloxy group, carbamoyl group, and amino group, wherein the alkyl group, aryl group, hetero-ring group, alkoxy group, aryloxy group, carbamoyl group, and amino group are substituted or unsubstituted. The hetero-group is composed of 5 to 6 membered rings, which are composed of the atoms of C, H, O, N, S and halogen. It may be saturated or unsaturated. $R_{15}$ expresses a group of 2 values selected from —CO—, —$SO_2$—, and —C(=NH)—. In this case, n is 0 or 1. In the case of n=0, $R_{14}$ expresses a group selected from an alkyl group, aryl group and hetero-ring group. $R_{13}$ and $R_{14}$ may compose a hetero-ring group in cooperation with each other.

Among the chemical compounds expressed by the formula [A], the chemical compounds expressed by the following formula [2] is preferable because they provide remarkable effect of the present invention.

Formula [2]

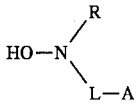

In the formula [2], L expresses an alkylene group, and A expresses a carboxyl group, sulfo group, phosphono group, phosphinic acid group, hydroxyl group, amino group, carbamoyl group and sulfamoyl group. R expresses a hydrogen atom or alkyl group. Any of L, A and R includes a straight chain and a branching chain. They may be either substituted or unsubstituted. L and R may be connected with each other so as to form a ring.

The chemical compounds expressed by the formula [2] will be further explained in detail. In the expression, L is a straight chain or branching chain of alkylene group, which may be substituted, the carbon number of which is 1 to 10. In this case, it is preferable that the carbon number is 1 to 5. Specifically, preferable examples are: a methylene group, ethylene group, trimethylene group and propylene group. Example of the substituent are: a carboxyl group, sulfo group, phosphono group, phosphine acid group, hydroxyl group, ammoniac group which may be subjected to alkyl substitution. Preferable examples are: a carboxyl group, sulfo group, phosphono group, and hydroxyl group. A expresses a carboxyl group, sulfo group, phosphono group, phosphine acid group, hydroxyl group, amino group, ammoniac group, carbamoyl group or sulfamoyl group, wherein an amino group, ammoniac group, carbamoyl group and sulfamoyl group may be subjected to alkyl substitution. Preferable examples are: a carboxyl group, sulfo group, hydroxyl group, phosphono group, and carbamoyl group which may be subjected to alkyl substitution. Preferable examples of —L—A are: a carboxymethyl group, carboxyethyl group, carboxypropyl group, sulfoethyl group, sulfopropyl group, sulfobutyl group, phosphonomethyl group, phosphonoethyl group, and hydroxyethyl group. More preferable examples are: a carboxymethyl group, carboxyethyl group, sulfoethyl group, sulfopropyl group, phosphonomethyl group, and phosphonoethyl group. R expresses a hydrogen atom, or a straight-chain or branched alkyl group having 1 to 10 carbon atoms, which may be substituted. It is preferable that the number of carbon atoms is 1 to 5. Example of the substituent are: a carboxyl group, sulfo group, phosphono group, phosphine acid group, hydroxyl group, ammoniac group, ammoniac group, carbamoyl group or sulfamoyl group, wherein the ammoniac group, ammoniac group, carbamoyl group and sulfamoyl group may be subjected to alkyl substitution. In this case, the number of substituents may be not less than 2. Preferable examples of R are: a hydrogen atom, carboxymethyl group, carboxyethyl group, carboxypropyl group, sulfoethyl group, sulfopropyl group, sulfobutyl group, phosphonomethyl group, phosphonoethyl group, and hydroxyethyl group. More preferable examples are: a hydrogen atom, carboxymethyl group, carboxyethyl group, sulfoethyl group, sulfopropyl group, phosphonomethyl group, and phosphonoethyl group. In this case, L and R may be connected with each other so that a ring can be formed.

Typical chemical compounds expressed by the formula [2] are shown as follows. It should be noted that the present invention is not limited to these specific chemical compounds.

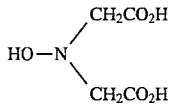
D-(1)

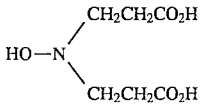
(D-(2)

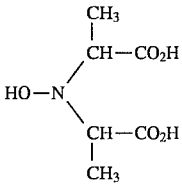
D-(3)

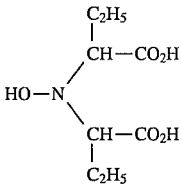
D-(4)

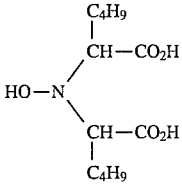
D-(5)

-continued

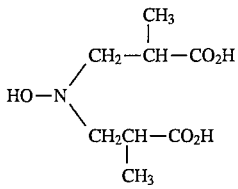
D-(6)

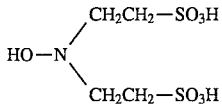
D-(7)

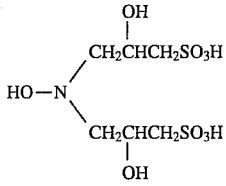
D-(8)

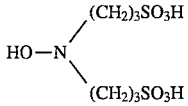
D-(9)

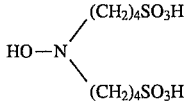
D-(10)

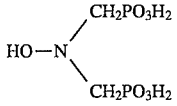
D-(11)

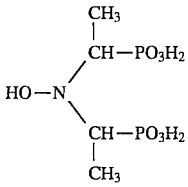
D-(12)

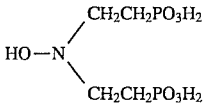
D-(13)

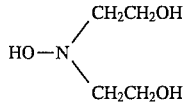
D-(14)

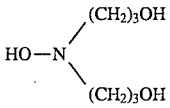
D-(15)

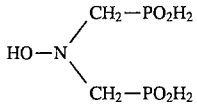
D-(16)

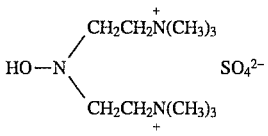
D-(17)

-continued

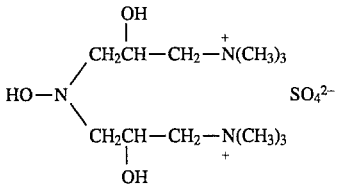

D-(18)

$HO-NH-CH_2CO_2H$ D-(19)

$HO-NH-CH_2CH_2CO_2H$ D-(20)

$HO-NH-CH(CH_3)-CO_2H$ D-(21)

$HO-NH-CH(C_2H_5)-CO_2H$ D-(22)

$HO-NH-CH(C_4H_9)-CO_2H$ D-(23)

$HO-NH-CH(CH_3)-CH_2-CO_2H$ D-(24)

$HO-NH-CH_2-CH(CH_3)-CO_2H$ D-(25)

$HO-NH-CH_2CH_2SO_3H$ D-(26)

$HO-NH-CH_2CH(OH)CH_2SO_3H$ D-(27)

$HO-NH-(CH_2)_3SO_3H$ D-(28)

$HO-NH-(CH_2)_4SO_3H$ D-(29)

$HO-NH-CH_2PO_3H_2$ D-(30)

$HO-NH-CH(CH_3)-PO_3H_2$ D-(31)

$HO-NH-CH_2CH_2PO_3H_2$ D-(32)

$HO-NH-CH_2CH_2OH$ D-(33)

$HO-NH-(CH_2)_3OH$ D-(34)

$HO-NH-CH_2-PO_3H_2$ D-(35)

D-(36)

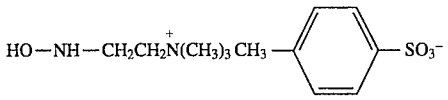

D-(37)

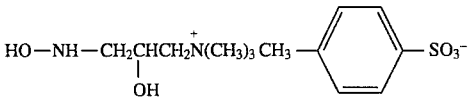

D-(38)

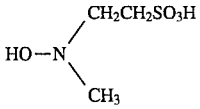

D-(39)

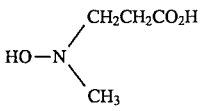

-continued

D-(40)

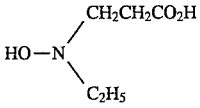

D-(41)

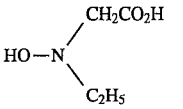

D-(42)

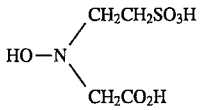

D-(43)

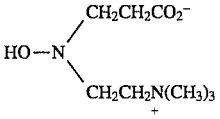

D-(44)

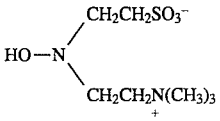

D-(45)

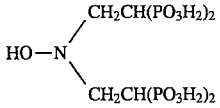

$HONHCH_2CH(PO_3H_2)_2$ D-(46)

D-(47)

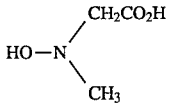

D-(48)

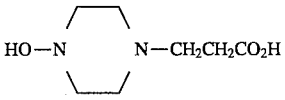

D-(49)

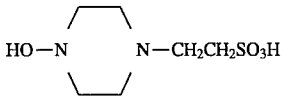

D-(50)

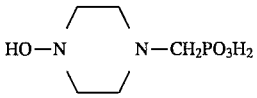

D-(51)

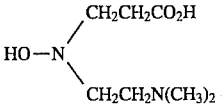

D-(52)

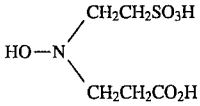

D-(53)

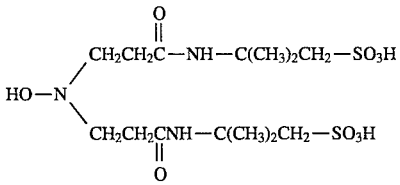

$HO-NHCH_2CH_2\underset{\underset{O}{\|}}{C}-NHC(CH_3)_2-C(CH_3)_2-CH_2-SO_3H$ D-(54)

-continued

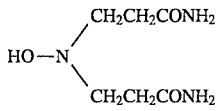

D-(55)

Chemical compounds shown by these formula [A] or [B] are commonly used in the form of free amine, hydrochloride, sulfate, p-toluene sulfonate, oxalate, phosphate or acetate. To the color developing agent used for the developing apparatus of the present invention, a small amount of sulfite can be added as preservatives. Examples of usable sulfite are: sodium sulfite, potassium sulfite, sodium bisulfite, and potassium bisulfite. A buffer can be added to the color developing agent used for the developing apparatus of the present invention. Examples of usable buffers are: potassium carbonate, sodium carbonate, sodium bicarbonate, potassium bicarbonate, sodium tertiary phosphate, potassium tertiary phosphate, potassium binary phosphate, sodium borate, potassium borate, sodium tetraborate (boric acid), potassium tetraborate, o-hydroxy sodium benzoate (sodium salicylate), o-hydroxy potassium benzoate, 5-sulfo-2-hydroxy sodium benzoate (5-sulfo sodium salicylate), 5-sulfo-2-hydroxy potassium benzoate (5-sulfo potassium salicylate), and 5-sulfo-hydroxy potassium benzoate (5-sulfo potassium salicylate).

Examples of usable development accelerating agents are: thioether compounds, p-phenylene diamine compounds, quaternary ammonium salt, p-aminophenol, amine compounds, polyalkylene oxide, 1-phenyl-3-pyrazolidone, hydrazine, meso-ionic compounds, ionic compounds, and imidazole. These development accelerating agents are added when necessary.

It is preferable that the color developing solution and color developing agent do not substantially contain benzylalcohol.

For the purpose of preventing the occurrence of fog, chloric ions and bromic ions can be added to the color developing solution in the processing tank. In the case where chloric ions are directly added into the color developing agent, chlorides of sodium, potassium, ammonium, nickel, magnesium, manganese, calcium or cadmium are used as the chloric ion supply substance. It is preferable to use sodium chloride or potassium chloride. These chlorides may be added in the form of counter salt of the fluorescent whitening agent to be added to the color developing agent. Bromides of sodium, potassium, ammonium, lithium, calcium, magnesium, manganese, nickel, cadmium, cerium or thallium are used as the bromic ion supply substance. It is preferable to use potassium bromide or sodium bromide.

In order to enhance the effect of the present invention, it is preferable that the color developing agent used in the present invention contains a fluorescent whitening agent of triazinyl stilbene. It is preferable to use chemical compounds expressed by the following formula [E] as the fluorescent whitening agent.

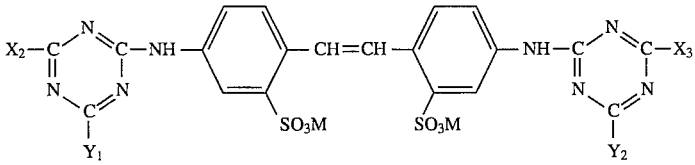

Formula [E]

In the above expression, $X_2$, $X_3$, $Y_1$ and $Y_2$ respectively express a hydroxyl group, halogen atom, alkyl group, aryl group,

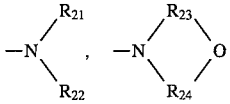

or —$OR_{25}$. In this case, $R_{21}$ and $R_{22}$ respectively express a hydrogen atom, alkyl group (including a substituent) or aryl group (including a substituent). $R_{23}$ and $R_{24}$ express an alkylene group (including a substituent). $R_{25}$ expresses a hydrogen atom, alkyl group (including a substituent) or aryl group (including a substituent). M expresses cation.

Further, various additives such as a stain preventing agent, sludge preventing agent and interlayer effect accelerating agent may be added.

In order to effectively accomplish the object of the present invention, it is preferable to add a chelate agent expressed by the following formulas [K-I] to [K-V] to the color developing agent and black and white developing agent composition.

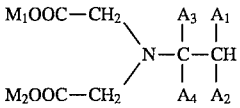

Formula [K-I]

In the above formula, $A_1$ to $A_4$ may be the same or different from each other. $A_1$ to $A_4$ express a hydrogen atom, hydroxy group, —COOM, —$PO_3(M)_2$, —$CH_2$COOM, —$CH_2$OH, or lower alkyl group which may have a substituent. However, at least one of $A_1$ to $A_4$ is either —COOM, —$PO_3(M)_2$, or —$CH_2$COOM. Each of M, $M_1$ and $M_2$ independently expresses a hydrogen atom, ammonium group, alkali metal or organic ammonium group.

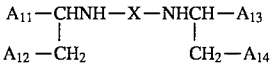

Formula [K-II]

In the above formula, $A_{11}$ to $A_{14}$ may be the same or different from each other. $A_{11}$ to $A_{14}$ express —$CH_2$OH, —COOM, or —$PO_3(M)_2$. M expresses a hydrogen atom, ammonium group, alkali metal organic ammonium group. X expresses an alkylene group, the carbon number of which is 2 to 6, or —$(B_1O)_n$—$B_2$—. In this case, n is an integer of 1 to 8. $B_1$ and $B_2$ may be the same or different from each other and express an alkylene group, the carbon number of which is 1 to 5.

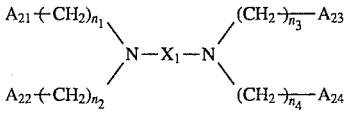

Formula [K-III]

In the formula, $A_{21}$ to $A_{24}$ may be the same or different from each other. $A_{21}$ to $A_{24}$ independently express —$CH_2$OH, —COOM, —N[$(CH_2)n_5$COOH], [$(CH_2)n_6$COOH)], or —$PO_3(M)_2$. M expresses a hydrogen atom, ammonium group, alkali metal organic ammonium group. $X_1$ expresses an alkylene group of straight chain or branch, the carbon number of which is 2 to 6, a saturated or unsaturated organic group forming a ring, or $—(B_{111}O)n_7-B_{12}$. In this case, $n_7$ expresses an integer of 1 to 8, and $B_{11}$ to $B_{12}$ may be the same or different from each other and express an alkylene group, the carbon number of which is 1 to 5. Numerals $n_1$ to $n_6$ express an integer not less than 1 to 4 and may be the same or different from each other.

Formula [K-IV]

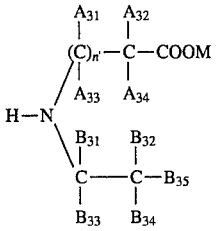

In the formula, n' expresses an integer of 1 to 3. $A_{31}$ to $A_{34}$, $B_{31}$ to $B_{35}$ express —H, —OH, $—C_nH_{2n+1}$ or $—(CH_2)_mX$, wherein n expresses an integer of 1 to 3, and m expresses an integer of 0 to 3. X expresses —COOM (M expresses a hydrogen atom, cation, or an alkali metal atom), $—NH_2$, or —OH. However, it should be noted that all of $B_{31}$ to $B_{35}$ are not hydrogen atoms.

Formula [K-V]

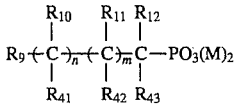

In the formula, $R_9$ to $R_{11}$ express a hydrogen atom, —OH, or a substituted or unsubstituted lower alkyl group, wherein examples of the substituent are —OH, —COOM and $—PO_3M_2$. $B_{41}$ to $B_{43}$ express a hydrogen atom, —OH, —COOM, $—PO_3M_2$, or $—N(R')_2$. R' expresses a hydrogen atom, alkyl group, the carbon number of which is 1 to 5, or $—PO_3M_2$. M expresses a hydrogen atom or alkali metal. In this case, n and m independently express an integer of 0 or 1.

K-I-1

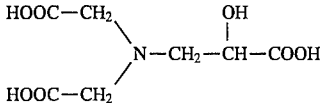

K-I-2

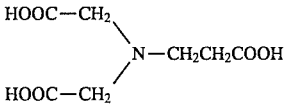

K-I-3

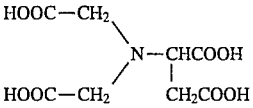

K-I-4

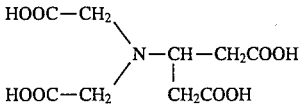

K-I-5

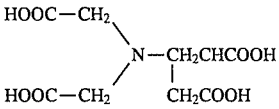

K-II-1

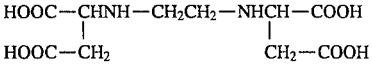

-continued

K-II-2

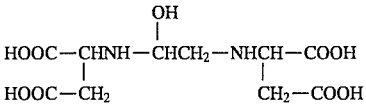

K-II-3

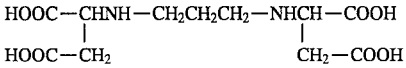

K-II-4

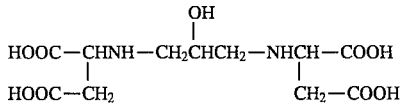

K-II-5

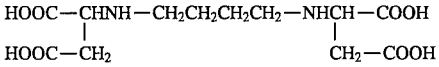

K-II-6

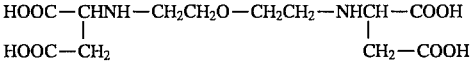

K-II-7

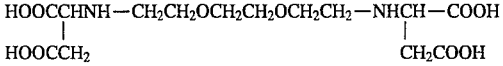

K-II-8

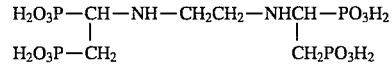

K-II-9

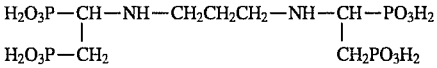

K-III-1

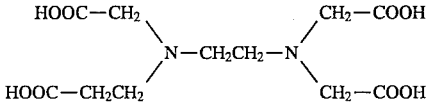

K-III-2

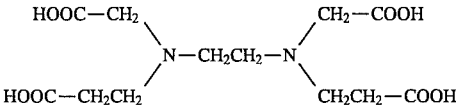

K-III-3

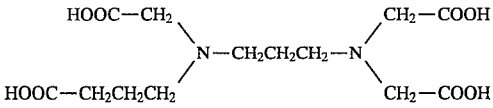

K-III-4

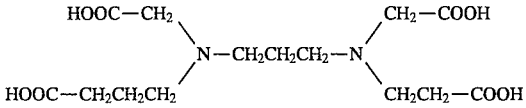

K-III-5

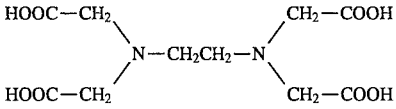

K-III-6

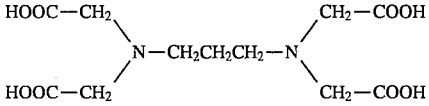

K-III-7

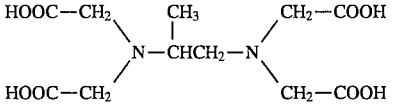

K-III-8

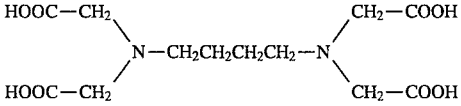

-continued

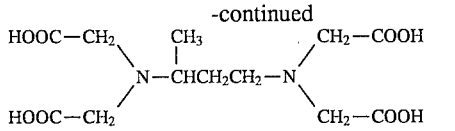
K-III-9

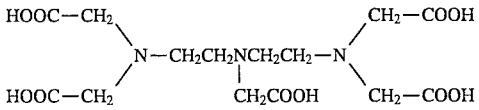
K-III-10

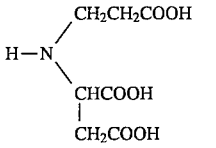
K-IV-1

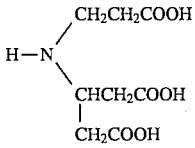
K-IV-2

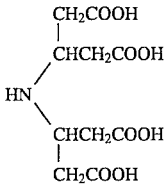
K-IV-3

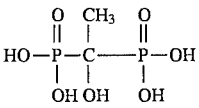
K-V-1

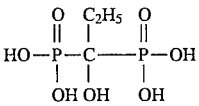
K-V-2

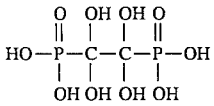
K-V-3

It is preferable to use the chelate agents of K-I-2, K-II-1, K-II-5, K-III-10, K-IV-1 and K-V-1. When these chelate agents are used, the effect of the present invention can be effectively provided. Further, the above color developing agents may contain an anionic, cationic, amphoteric or nonionic surface active agent. When necessary, various surface active agents such as alkylsulfonic acid, aryl sulfonic acid, aliphatic carboxylic acid, and aromatic carboxylic acid. When the concentration of the paraphenylene diamine color developing agent in the processing agent in the color developing tank is not less than 0.018 mol/l, the effect of the present invention can be further enhanced, and it is more preferable that the concentration is not less than 0.020 mol/l. In this connection, in the examples of the present invention described later, the concentration was 0.022 mol/l.

According to the present invention, it is preferable that the temperature of the processing solution in the color developing tank is controlled to be in a predetermined temperature range. It is more preferable that the temperature of the processing solution in the color developing tank is controlled to be in a temperature range of ±1.5° C., and it is most preferable that the temperature of the processing solution in the color developing tank is controlled to be in a temperature range of ±0.5° C.

In the present invention, the solid processing agent for color development use may contain a color developing agent, alkaline agent and preservatives in one tablet. Alternatively, the color developing agent, alkaline agent and preservatives may be individually formed into one tablet.

In the present invention, it is preferable to use a silver halide photosensitive material containing a silver halide emulsion in which not less than 80 mol % of silver halide composition is silver chloride, more preferably, not less than 90 mol % of silver halide composition is silver chloride. Due to the foregoing, the effect of the present invention can be enhanced.

DETAILED DESCRIPTION OF THE PREFERRED EMBODIMENTS

The preferred embodiments of the present invention will be explained below, however, it should be noted that the present invention is not limited to the specific embodiments.

Example 1

Figure 1:
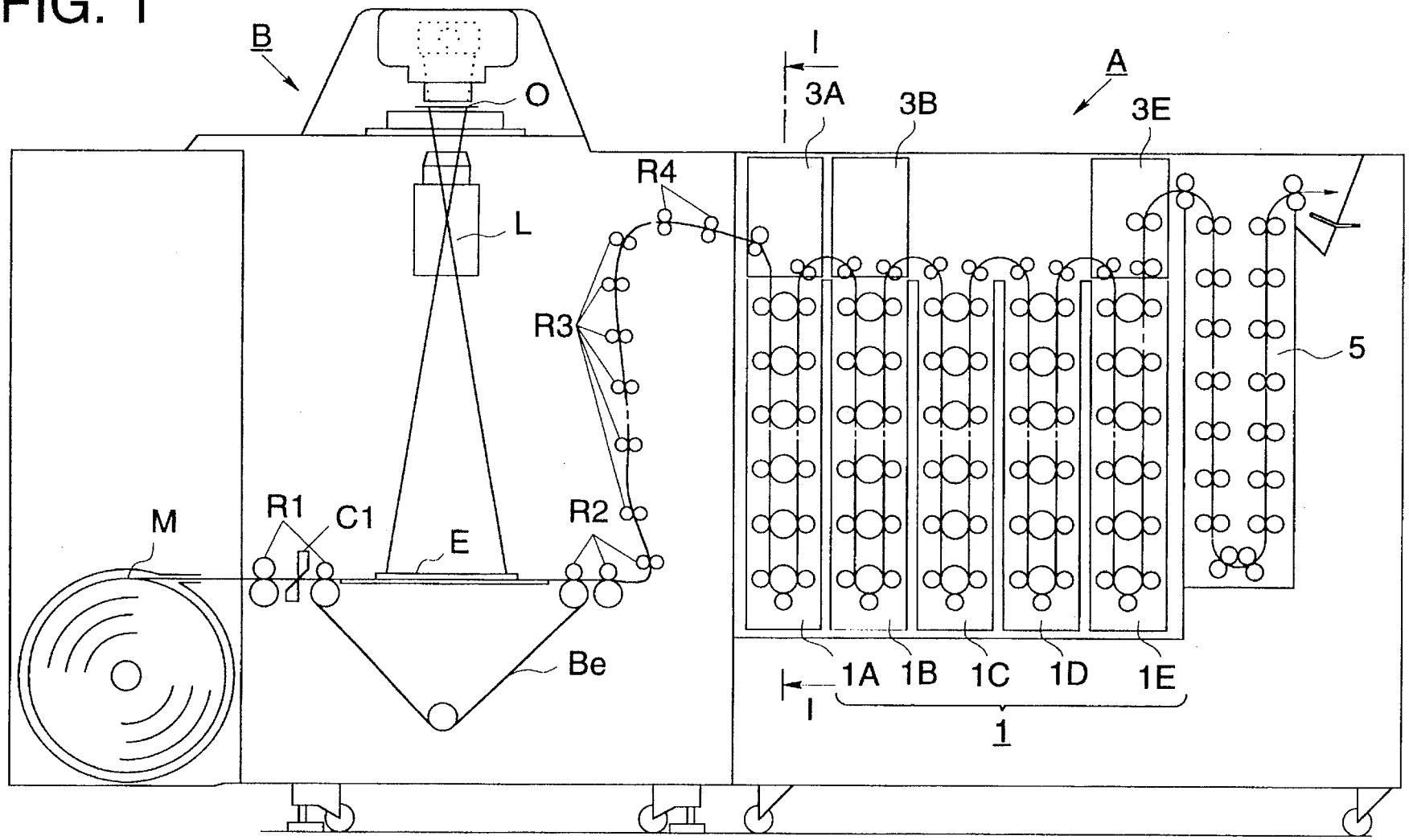
FIG. 1 is an overall arrangement view of the silver halide photosensitive material processing apparatus.

An automatic developing apparatus to which the present invention can be applied will be explained with reference to the accompanying drawings. The automatic developing apparatus of this example is a modified NPS818 type automatic developing apparatus manufactured by Konica Co., Ltd. FIG. 1 is a schematic illustration showing the construction of a silver halide photosensitive material processing apparatus (printer processor) in which the automatic developing apparatus A and photographic printer B are integrated.

In FIG. 1, in the left lower portion of the photographic printer B, there is provided a magazine M in which a roll of photographic paper, which is an unexposed silver halide photographic material, is accommodated. The photographic paper is pulled out from the magazine M and conveyed by the feed rollers $R_1$ and cut into a predetermined size by the cutter C. In this way, a sheet of photographic paper can be provided. This sheet of photographic paper is conveyed by the belt conveyance means Be. Then an image of the original O is exposed onto the sheet of photographic paper by a light source and lens L in the exposure section E. The exposed sheet of photographic paper is further conveyed by a plurality of pairs of feed rollers R2, R3 and R4, so that the sheet of photographic paper is introduced into the automatic developing apparatus A. In the automatic developing apparatus A, the sheet of photographic paper is successively conveyed by a roller conveyance means (the reference numeral is not attached to the means) into the color development tank 1A, bleaching and fixing tank 1B and stabilizing tanks (the first stabilizing tank 1C, the second stabilizing tank 1D, and the third stabilizing tank 1E), wherein these 3 tanks substantially compose a processing tank 1T. Due to the foregoing, the sheet of exposed photographic paper is subjected to color development, bleaching and fixing processing and stabilizing processing. After the processing has been completed, the sheet of photographic paper is dried by the drying section 5, and then discharged outside of the apparatus. It should be noted that the present invention is not limited to the specific embodiment described above. It is possible to apply the present invention to an automatic developing apparatus substantially composed of 4 tanks of a color developing tank, bleaching tank, fixing tank and stabilizing tank.

In this connection, the one-dotted chain line in the drawing shows a conveyance passage of the silver halide photosensitive material. In this example, the photosensitive material is cut into a sheet and introduced into the automatic developing apparatus A, however, a strip-shaped photosensitive material may be introduced into the automatic developing apparatus A in the present invention. In this case, the processing efficiency can be enhanced when an accumulator for temporarily stocking the photosensitive material is provided between the automatic developing apparatus A and photographic printer B. Of course, the automatic developing apparatus A of the present invention may be constructed integrally with the photographic printer B, or alternatively the automatic developing apparatus A of the present invention may be constructed separately from the photographic printer B. Of course, the silver halide photosensitive material processed by the automatic developing apparatus A of the present invention is not limited to the exposed photographic paper, but an exposed negative film may be applied to the automatic developing apparatus A of the present invention.

The color development tank 1A, the bleaching and fixing tank 1B and the third stabilizing tanks 1E are respectively provided with the solid processing agent supply devices 3A, 3B and 3E for supplying the solid processing agent.

Figure 2:
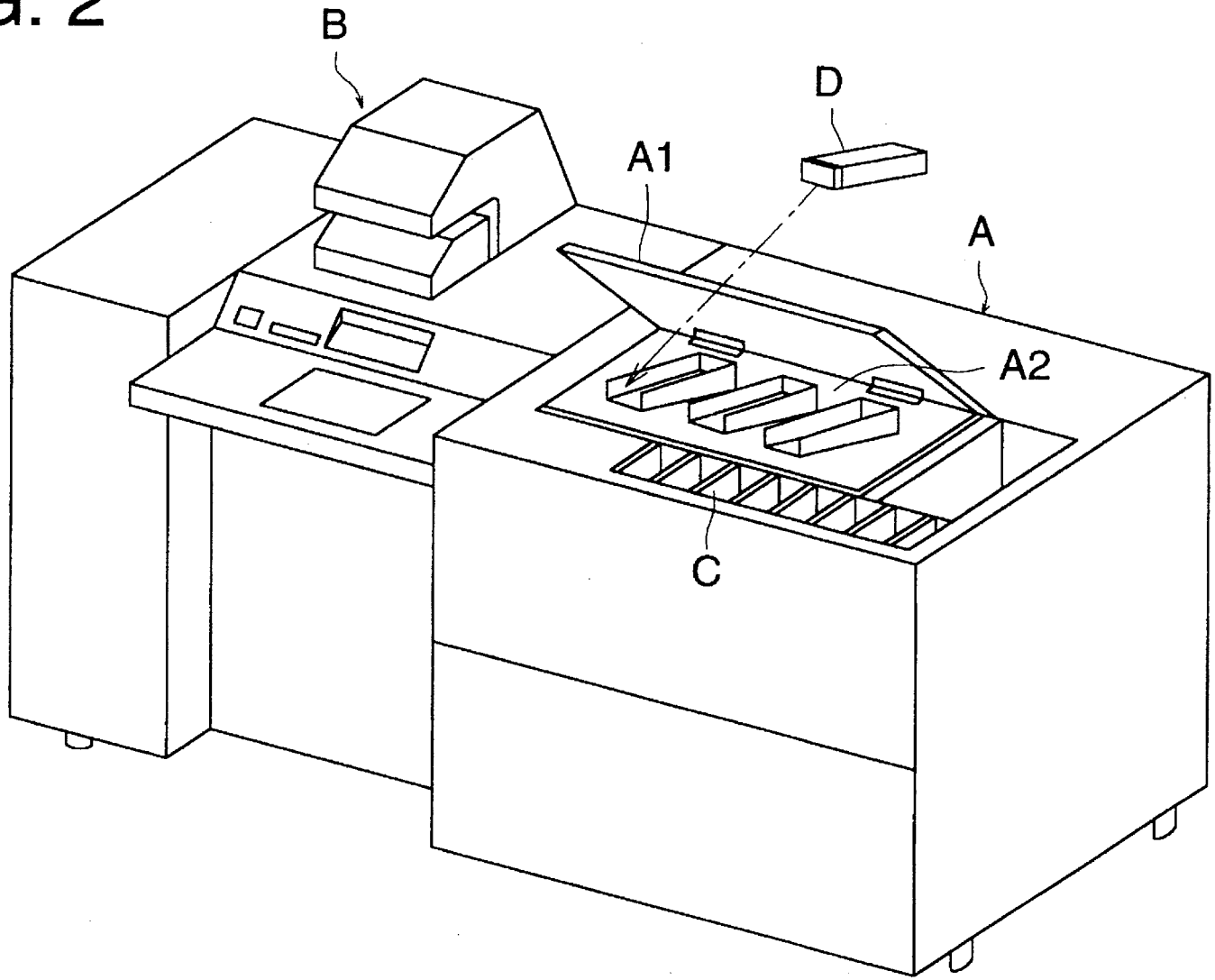
FIG. 2 is a perspective view of the above silver halide photosensitive material processing apparatus.

FIG. 2 is a perspective view showing the entire photosensitive material processing apparatus in which the automatic developing apparatus A of the present invention, photographic printer B and sorter C are integrally combined. In FIG. 2, the cover A1 of the automatic developing apparatus A is opened upward, and the accommodating container D having solid processing agent is inserted into the attaching section A2 from the left upper to the right lower position in the drawing. After that, they are fixed.

Figure 3:
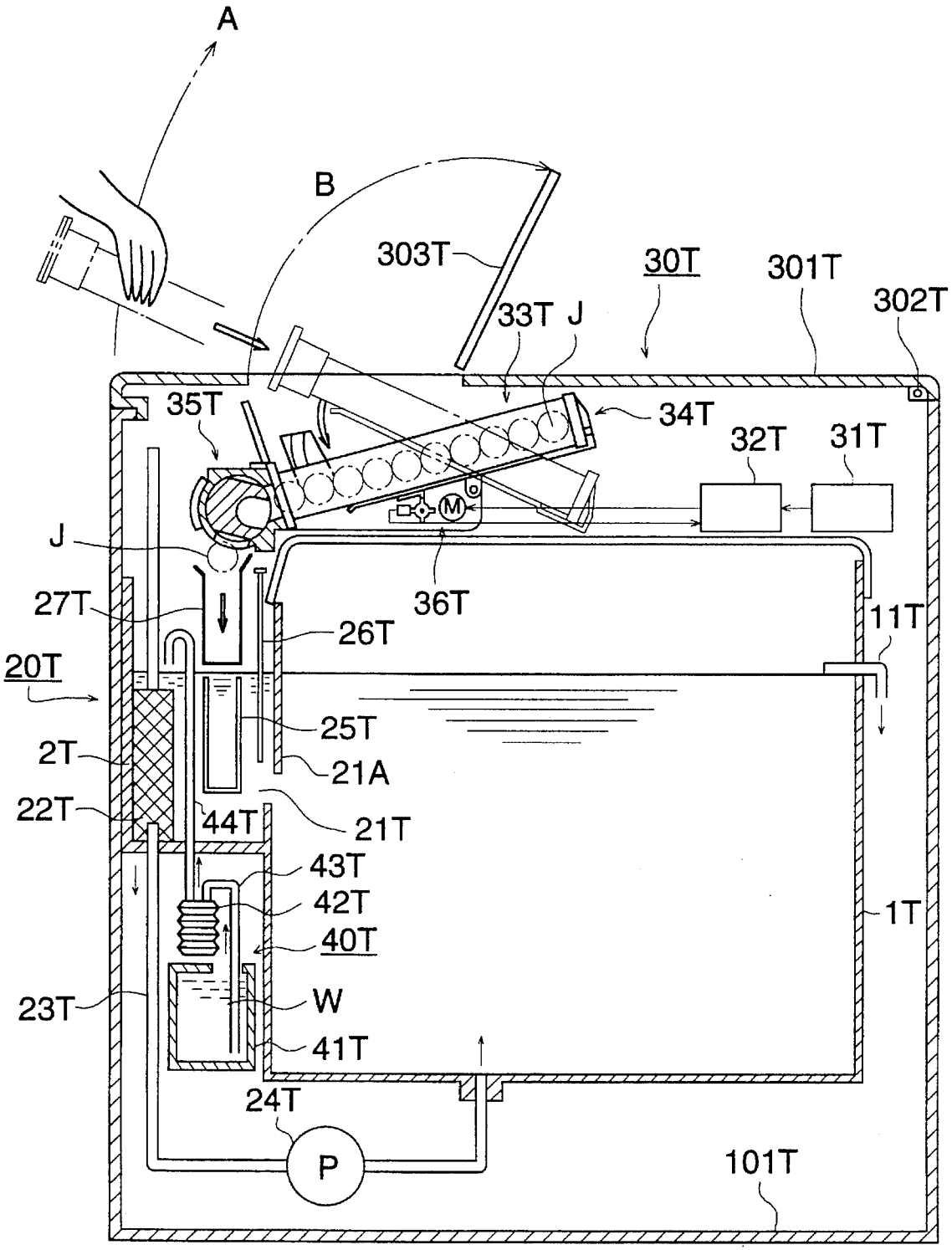
FIG. 3 is a sectional view of the automatic developing apparatus of the present invention.

FIG. 3 is a sectional view of the auxiliary tank and processing agent supply means of the color development tank A taken on line I—I in FIG. 1. In this case, the construction of the bleaching and fixing tank 1B and that of the stabilizing tanks (the first stabilizing tank 1C, the second stabilizing tank 1D, and the third stabilizing 1E) are the same as the construction of the color development tank 1A. Therefore, the explanation of the processing tank 1T can be applied to all tanks of the color development tank 1A, the bleaching and fixing tank 1*b*, and the stabilizing tanks (the first stabilizing tank 1C, the second stabilizing tank 1D, and the third stabilizing 1E). In this connection, for enhancing the understanding of the invention, the conveyance means for conveying the photosensitive material is omitted in the drawing. In this example, explanations will be made under the condition that tablets of solid processing agent are used. The processing tank 1T for processing the photosensitive material is provided with an auxiliary tank 2T integrally attached to the outside of the partition wall forming the processing tank 1. A solid processing agent charging section 20T is arranged at an upper portion of the auxiliary tank 2T. Tablets J supplied from the solid processing agent supply means 3A, 3B, 3E pass through the solid processing agent charging section 20T and are supplied to the auxiliary tank 2T. The processing tank 1T and the auxiliary tank 2T are separate from each other by the partition wall 21A on which a communication window 21T is formed, so that the processing solution can be communicated through the communication window 21T. The auxiliary tank 2T is provided with an enclosure 25T in which the tablets J are received. In this connection, the enclosure 25T is made of material such as a net so that the processing solution can pass through the enclosure 25T, however, the tablets J in the form of a solid body can not pass through the enclosure 25T until they are dissolved in the solution.

A cylindrical filter 22T is disposed below the auxiliary tank 2T in such a manner that the cylindrical filter 22T can be replaced. The cylindrical filter 22T removes an undissolved object such as precipitations in the processing solution. A circulation pipe 23T connected with the suction side of a circulation pump 24T (circulation means) is inserted into the filter 22T penetrating through the lower wall of the auxiliary tank 2T.

The circulation system includes the circulation pipe 23T forming a circulation passage of the processing solution, and also includes the circulation pump 24T, the processing tank 1T and the auxiliary tank 2T. One end of the circulation pipe 23T is communicated with the delivery side of the circulation pump 24T, and the other end penetrates a lower wall of the processing tank 1T, so that the circulation pipe 23T is communicated with the processing tank 1T. Due to the foregoing construction, when the circulation pump 24T is operated, the processing solution is sucked from the auxiliary tank 2T and discharged into the processing tank 1T, so that the discharged processing solution is mixed with the processing solution in the processing tank 1T, and then sent to the auxiliary tank 2T. In this way, the processing solution is circulated. In the present invention, the circulating direction of the processing agent is not limited to the direction shown in FIG. 3, but the direction may be reverse to that shown in FIG. 3.

A waste solution pipe lit is provided for permitting the processing solution in the processing tank 1T to overflow, so the solution level can be maintained constant and an increase in the components conveyed from other tanks into the processing tank 1T can be prevented. Further, an increase in the components oozing out from the photosensitive material can be prevented.

A rod-shaped heater 26T penetrates an upper wall of the auxiliary tank 2T, and is dipped in the processing solution in the auxiliary tank 2T. The processing solution in the auxiliary tank 2T and processing tank IT is heated by this heater 26 in accordance with a temperature detected by a thermometer not shown in the drawing arranged in the auxiliary tank 2T. In other words, the heater 26T is a temperature regulating means for regulating the temperature of the processing solution in the processing tank 1T, so that the temperature can be controlled in an appropriate range, for example, in a range from 20° to 55° C.

A photoelectric sensor to be used as a throughput information detecting means 31T is disposed at an entrance of the automatic developing apparatus A, and detects the throughput of the photosensitive material to be processed. This throughput information detecting means 31T is comprised of a plurality of detecting members that are disposed in a transverse direction. This throughput information detecting means 31T detects the width of photosensitive material, and the result of detection is used for counting the detection time. Since the conveyance speed of photosensitive material is previously set in a mechanical manner, the throughput of photosensitive material, that is, the area of processed photosensitive material can be calculated form the width and time information. An infrared ray sensor, microswitch and ultrasonic sensor capable of detecting the width and conveyance time of photosensitive material can be used for this throughput information detecting means 31T. A means for indirectly detecting the area of processed photosensitive material may be used for this throughput information detecting means 31. For example, in the case of the printer processor shown in FIG. 1, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31T may be disposed at an appropriate position so that detection can be conducted after processing or while the photosensitive material is being processed. It is not necessary to provide the throughput information detecting means 31T for each processing tank 1A, 1B, 1C, 1D, 1E, and it is preferable that one throughput information detecting means 31T is provided for one automatic developing apparatus A. The solid processing agent supply control means 32T receives a signal from the throughput information detecting means 31T so that the supply of the processing agent conducted by the solid processing agent supply means 30T is controlled and further the supply of replenishment water conducted by the replenishment water supply means 40T is controlled.

The solid processing agent replenishing device 30T used for the photosensitive material processing apparatus of the present invention is disposed above the processing tank 1T of the photosensitive material processing apparatus, and comprises an accommodating container 33T, accommodating container charging means 34T, supply means 35T and drive means 36T, wherein the solid processing agent replenishing device 30T is tightly closed by an upper cover 301. The upper cover 301T is rotatably connected with a main body 101T accommodating the processing tank 1T and auxiliary tank 2T, through a support shaft 302T attached to the back of the main body. The upper cover 301T is lifted upward as shown by a one-dotted chain line in the drawing, so that the front and upper portions of the apparatus can be widely opened. In this way, inspection of the solid processing agent replenishing device 30T, and replacement of the filter 22T can be easily conducted.

A skylight 303T is rotatably connected with a portion of the upper surface of the upper cover 301T. When the skylight 303T is opened as illustrated by a one-dotted chain line B in the drawing, the accommodating container 33T is attached or replaced.

At a position close to the auxiliary tank 2T in the main body 101T of the photosensitive material processing apparatus, there is provided a replenishment water supply means 40T. The replenishment water supply means 40T includes: a replenishment water tank 41T, bellows pump 43T, suction pipe 43T, and water feed pump 44T. Replenishment water W accommodated in the replenishment water tank 41T is sucked by the action of the bellows pump 42T and flows in the suction pipe 43T. After that, replenishment water W is extruded by the bellows pump 42T and flows in the water supply pipe 44T. In this way, replenishment water W is supplied to an upper portion of the processing solution accommodated in the auxiliary tank 2T. A drive motor of the bellows pump 42T is rotated being controlled by the replenishment water supply control means 45T, so that replenishment water W is intermittently replenished by the bellows pump 42T.

A solid processing agent for processing photographic color paper was made in the following manner.

[1] Solid processing agent (1) for developing photographic color paper was prepared as follows.

OPERATION (1)

In this case, the developing agent of CD-3 is used, that is, 1350.0 g of 4-amino-3-methyl-N-ethyl-[β-(methanesulfoneamide)ethyl]aniline sulfate is ground by a Bandam Mill available on the market so that the average particle size can be 10 μm.

To the thus obtained fine powder, 1000.0 g of polyethylene glycol, the weight average molecular weight of which is 6000, is added and mixed uniformly by a mixer available on the market. Next, the mixture is subjected to a granulating machine available on the market for 7 minutes at the room temperature while 50 ml of water is added to the mixture. In this way, the granulation is effected. The thus obtained granules are dried by a fluidized-bed dryer for 2 hours at a temperature of 40° C., so that the moisture in the granules is substantially completely removed.

OPERATION (2)

In Operation (2), 400.0 g of bis(sulfoethyl)hydroxylaminedisodium, 1700.0 g of p-toluene sodium sulfonate, and 300.0 g of Chinopal SFP (manufactured by Chibaeigy Co.) are ground in the same manner as that of Operation (1). The thus obtained mixture is mixed with 240.0 g of Pineflow (manufactured by Matsutani Kagaku Co.) using a mixer available on the market. Next, in the same manner as that of Operation (1), granulation is conducted while 60 ml of water is added. The thus obtained granules are dried for 2 hours at a temperature of 50° C., so that the moisture in the granules is substantially completely removed.

OPERATION (3)

In the same manner as that of Operation (1), 330.0 g of pentasodium diethylenetriamine pentaacetate, 130.0 g of p-toluene sodium sulfonate, 37.0 g of sodium sulfite, 340.0 g of lithium hydroxide monohydrate, and 3300.0 g of potassium carbonate anhydride are ground in the same manner as that of Operation (1). The thus obtained mixture is mixed with 500.0 g of polyethyleneglycol, the weight average molecular weight of which is 4000, and 600.0 g of mannitol using a mixer available on the market in a room, the humidity of which is adjusted to be not more than 40% RH. Next, in the same manner as that of Operation (1), granulation is conducted while 800 ml of water is added. The thus obtained granules are dried for 30 minutes at a temperature of 60° C., so that the moisture in the granules is substantially completely removed.

OPERATION (4)

All the granules made in Operations (1) to (3) are mixed for 10 minutes using a cross rotary type mixed available on the market at the room temperature. To the thus obtained mixture, 50.0 g of N-myristoyl-alanine sodium is added and mixed uniformly by a mixer available on the market for 3 minutes. Then the mixture is subjected to a rotary type tablet machine (type Clean Press Correct H18 manufactured by Kikusui Seisakusho Co.), and tablets are made under the condition that the diameter is 30 mm, the thickness is 10 mm, and the amount of charging per one tablet is 10.5 g. In this case, the tablet making force is set at 7 t, and tablets are continuously made. In this way, tablets of the solid processing agent for color development of photographic color paper are made. Thus obtained tablets of the solid processing agent are defined as the solid processing agent (1) for color development.

[2] Solid processing agent (2) for color development of photographic color paper is made as follows.

OPERATION (5)

In this case, the developing agent of CD-3 is used, that is, 1480.0 g of 4-amino-3-methyl-N-ethyl-[β-(methanesulfoneamide)ethyl]aniline sulfate is ground by a BandamMill available on the market so that the average particle size can be 10 μm.

To the thus obtained fine powder, 1000.0 g of polyethylene glycol, the weight average molecular weight of which is 6000, is added and mixed uniformly by a mixer available on the market. Next, the mixture is subjected to a granulating machine available on the market for 7 minutes at the room temperature while 50 ml of water is added to the mixture. In this way, the granulation is effected. The thus obtained granules are dried by a fluidized-bed dryer for 2 hours at a temperature of 40° C., so that the moisture in the granules is substantially completely removed.

OPERATION (6)

All the granules made in Operations (2), (3) and (5) are mixed for 10 minutes using a cross rotary type mixed available on the market at the room temperature. To the thus obtained mixture, 50.0 g of sodium N-myristoyl-alanine is added and mixed uniformly by a mixer available on the market for 3 minutes. Then the mixture is subjected to a rotary type tablet machine (type Clean Press Correct H18 manufactured by Kikusui Seisakusho Co.), and tablets are made under the condition that the diameter is 30 mm, the thickness is 10 mm, and the amount of charging per one tablet is 10.5 g. In this case, the tablet making force is set at 7 t, and tablets are continuously made. In this way, tablets of the solid processing agent for color development of photographic color paper are made. Thus obtained tablets of the solid processing agent are defined as the solid processing agent (2) for color development.

[3] Solid processing agent (3) for color development of photographic color paper is made as follows.

OPERATION (7)

All the granules made in Operations (2), (3) and (5) are mixed for 10 minutes using a cross rotary type mixed available on the market at the room temperature. To the thus obtained mixture, 50.0 g of sodium N-myristoyl-alanine is added and mixed uniformly by a mixer available on the market for 3 minutes. Then the mixture is subjected to a rotary type tablet machine (type Clean Press Correct H18 manufactured by Kikusui Seisakusho Co.), and tablets are made under the condition that the diameter is 20 mm, the thickness is 8 mm, and the amount of charging per one tablet is 5 g. In this case, the tablet making force is set at 4 t, and tablets are continuously made. In this way, tablets of the solid processing agent for color development of photographic color paper are made. Thus obtained tablets of the solid processing agent are defined as the solid processing agent (3) for color development.

[4] Solid processing agent (4) for color development of photographic color paper is made as follows.

OPERATION (8)

All the granules made in Operations (2), (3) and (5) are mixed for 10 minutes using a cross rotary type mixed available on the market at the room temperature. To the thus obtained mixture, 50.0 g of sodium N-myristoyl-alanine is added and mixed uniformly by a mixer available on the market for 3 minutes. Then the mixture is subjected to a rotary type tablet machine (type Clean Press Correct H18 manufactured by Kikusui Seisakusho Co.), and tablets are made under the condition that the diameter is 17 mm, the thickness is 6 mm, and the amount of charging per one tablet is 2 g. In this case, the tablet making force is set at 2 t, and tablets are continuously made. In this way, tablets of the solid processing agent for color development of photographic color paper are made. Thus obtained tablets of the solid processing agent are defined as the solid processing agent (4) for color development.

[5] The solid processing agent for bleaching and fixing color paper are made as follows.

OPERATION (9)

In operation (9), 500.0 g of sodium carbonate monohydrate, 6000.0 g of ammonium ferric ethylenediaminepentaacetate trihydrate, and 300.0 g of ethylenediaminepentaacetic acid are ground in the same manner as that of Operation (1) so that the average particle size can be 10 μm. The thus obtained fine powder is mixed in the same manner as that of Operation (1). Then, 200 ml of water is added to this mixture and granules are made in the same manner as that of Operation (1). The thus obtained granules are dried by a fluidized-bed dryer for 3 hours at a temperature of 60° C., so that the moisture in the granules is substantially completely removed.

OPERATION (10)

In operation (10), 8000.0 g of ammonium thiosulfate and 3050.0 g of sodium metabisulfite are ground in the same manner as that of Operation (1). To this mixture, 500 g of Pineflow (manufactured by Matsutani Kagaku Co.) is added and mixed in the same manner as that of Operation (1). In the same manner as that of Operation (1), 170 ml of water is added, and the mixture is subjected to granulation. After granulation, granules are dried by a fluidized-bed drier for 2 hours at a temperature of 60° C., so that the moisture in the granules is substantially completely removed.

OPERATION (11)

Granules obtained in Operations (9) and (10) are mixed in the same manner as that of Operation (4), and 1000.0 g of polyethyleneglycol, the weight average molecular weight of which is 4000, and 97.0 g of sodium N-lauroyl sarcosine are added and mixed for 3 minutes using a mixer at a temperature of 25° C. in a room, the humidity of which is adjusted to be not higher than 40% RH. Then the thus obtained mixture is subjected to a rotary type tablet machine (type Tough Pressed Correct H18 manufactured by Kikusui Seisakusho Co.), and tablets, the diameter of which is 30 mm, the weight of which 11.0 g, are provided, which are used as the solid processing agent for bleaching and fixing photographic color paper.

[6] Solid processing agent for stabilizing color paper is prepared as follows.

OPERATION (12)

In this operation, 450.0 g of sodium carbonate.monohydrate, 3000.0 g of trisodium 1-hydroxyethane-1,1-diphosphate, 150.0 g of ethylenediamine tetraacetic acid disodium salt, and 70.0 g of o-phenylphenol are ground in the same manner as that of Operation (1). To this mixture, 500.0 g of polyethylene glycol, the weight average molecular weight of which is 6000, is added and mixed in the same manner as that of Operation (1). To this mixture, 60 ml of water is added. This mixture is subjected to granulation in the same manner as that of Operation (1). Then the thus obtained granules are dried for 2 hours at a temperature of 70° C. using a fluidized-bed drier, so that the moisture in the granules is substantially completely removed. Then 30.0 g of sodium N-lauroyl sarcosine is added and mixed for 3 minutes using a mixer at a temperature of 25° C. in a room, the humidity of which is adjusted to be not higher than 40% RH. Then the thus obtained mixture is subjected to a rotary type tablet machine (type Tough Pressed Correct H18 manufactured by Kikusui Seisakusho Co.), and tablets, the diameter of which is 30 mm, the weight of which 10.5 g, are provided, which are used as the solid processing agent for replenishment to stabilize the processing photographic color paper.

After a sheet of photographic paper, the containing ratio of silver chloride of which was 99.5 mol %, described in Example 1 of Japanese Patent Pubiication Open to Public Inspection No. 264550/1992, was exposed to light according to a normal method. Then the sheet of photographic paper was processed by a modified automatic developing apparatus of Type NPS manufactured by Konica Co., which is shown in FIGS. 1 to 4, wherein the tablets manufactured in the above manner were used in the development process. The development process will be shown below.

| Process | Processing temperature | Processing time | Replenishment amount of solid processing agent | Amount of added replenishment water |
|---|---|---|---|---|
| Color development | Described on Table 1 | Described on Table 1 | 7.8 g/m$^2$ | 65 ml/m$^2$ |
| Bleaching fixing | 35.0 ± 1.0° C. | 22 seconds | 6.2 g/m$^2$ | 80 ml/m$^2$ |
| First stabilization | 33.0 ± 3.0° C. | 22 seconds | — | — |
| Second stabilization | 33.0 ± 3.0° C. | 22 seconds | — | — |
| Third stabilization | 33.0 ± 3.0° C. | 22 seconds | 1.0 g/m$^2$ | 180 ml/m$^2$ |
| Drying | 72.0 ± 5.0° C. | 30 seconds | — | — |

Remark: In this case, the solid processing agent replenishment amount is an amount of solid processing agent replenished per 1 m$^2$ of a sheet of photographic paper.

Figure 4:
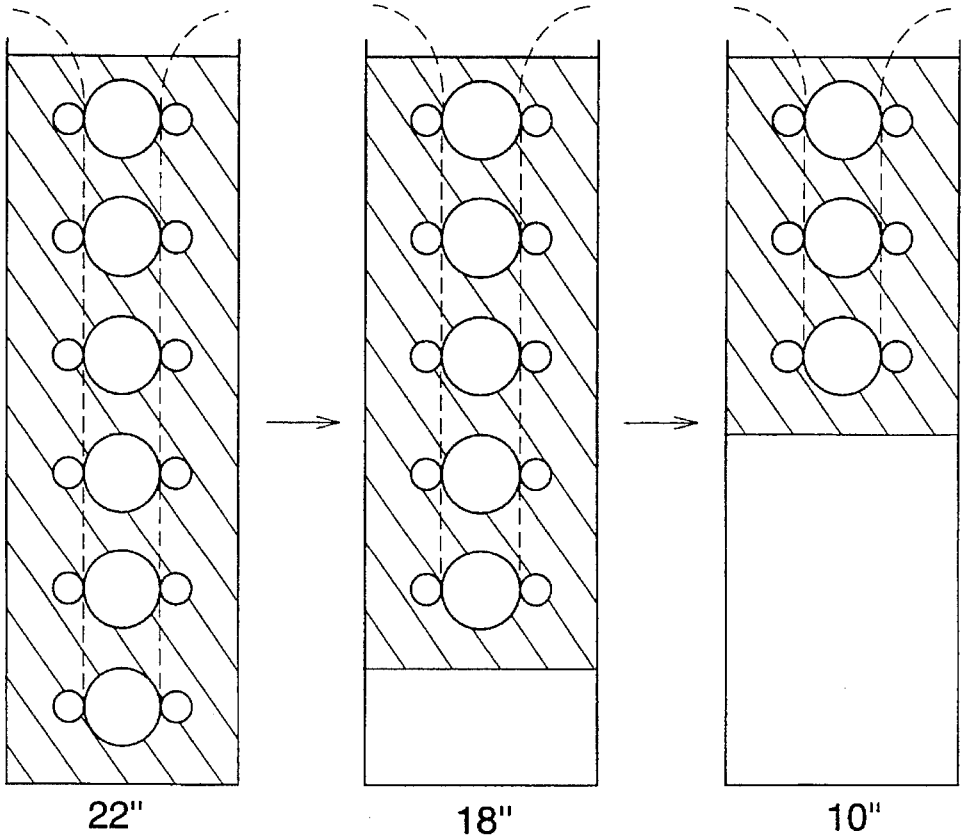
FIG. 4 is a schematic illustration showing variations of the color developing agent of Example 1.

Concerning the adjustment of processing time in the color development process, as illustrated in FIG. 4, the length of the processing rack was adjusted, so that the time was controlled as shown on the table.

In this case, a counter current system is employed in the stabilizing tank, in which the processing solution flows from the third to the first stabilizing tank. The processing solution that had overflowed the first stabilizing tank, the amount of which was 80 ml/m$^2$, was allowed to flow into the bleaching fixing tank. Concerning the change in the color developing time, as illustrated in FIG. 4, the color developing tank 1A was changed into a short color developing tank. Tablets of solid processing agent were set in a tablet supply device attached to the automatic developing apparatus. An amount of supply of the tablets per one operation was adjusted as shown on Table 1. In the case of bleaching fixing, 2 tablets (22.0 g) was supplied, and in the case of stabilizing, 1 tablet (10.5 g) was supplied. The charging interval was adjusted so that the amount of replenished solid processing agent could be the above values. In accordance with that, replenishment water was supplied, and an amount of replenishment water was adjusted. Under the above condition, processing was effected. The processing solution in each processing tank was prepared at the initial stage in accordance with the following composition.

| [COLOR DEVELOPMENT SOLUTION (PER 1l)] | |
|---|---|
| Sodium sulfite | 0.05 g |
| Pentasodium diethylenetriamine pentaacetate | 3.0 g |
| Polyethylene glycol of the weight average molecular weight of 4000 | 10.0 g |
| Bis(sodiumsulfoethyl)hydroxylamine | 4.0 g |
| Chinopal SFP (manufactured by Chibagaigi Co.) | 1.0 g |
| P-toluene sodium sulfonate | 30.0 g |
| Mannitol | 6.0 g |
| Potassium chloride | 4.0 g |
| Pineflow | 3.0 g |
| Developing agent 3-methyl-4-amino-N-ethyl-N-(β-methanesulfoneamideethyl)aniline sulfate [CD-3] | 8.0 g |
| Potassium carbonate | 33.0 g |
| Lithium hydroxide | 3.5 g |
| N-myristoyl-alanine sodium | 0.30 g |
| The PH is adjusted to 10.00 ± 0.05 using potassium hydroxide or sulfuric acid. | |

| [BLEACHING FIXING SOLUTION (PER 1l)] | |
|---|---|
| Ethylenediaminepentaacetic acid ferric sodium slat monohydrate | 60.0 g |
| Ethylenediaminepentaacetic acid | 6.7 g |
| Ammonium thiosulfate | 72.0 g |

-continued

| | |
|---|---|
| Sodium thiosulfate | 8.0 g |
| Ammonium metabisulfite | 7.5 g |
| The pH is adjusted to 6.0 ± 0.5 using potassium carbonate or maleic acid. | |

[STABILIZING SOLUTION (PER 1l)]

-continued

| | |
|---|---|
| Trisodium 1-hydroxyethylidene-1,1-disulfonate | 3.0 g |
| Ethylenediamine tetraacetic acid disodium salt | 1.5 g |
| Sodium carbonate | 0.5 g |
| o-phenyl phenol | 0.08 g |

The pH is adjusted to 8.0±0.5 using sodium carbonate or sulfuric acid.

As a comparative example, a replenishment solution was made in accordance with a ratio of the solid processing agent to the replenishment water shown in the process before, and the same processing was conducted by the automatic developing apparatus of type Nice Print System NPS818 (manufactured by Konica Co.) in which the conventional replenishment solution replenishing system was employed. In this case, an amount of each processing solution to be replenished was adjusted so that the amount of each processing solution could be the same as the total of the solid processing solution and the replenishment water shown in the process before. This system is referred to as "Conventional replenishment solution system" on Table 1. In any replenishing system, a corresponding amount of water was added to compensate an amount of evaporated water in each processing tank. In this way, running processing was conducted. This running processing was carried out for 12 hours per one day, so that 5 $m^2$ of color paper was continuously processed per one day. This operation was continued for 2 weeks.

[EXPERIMENT 1: Generation of stain in the running test]

Sheets of color paper that had been normally exposed by means of wedge exposure were processed at the stage of an initial processing solution and also at the stage after the running processing. The minimum reflected blue density ($D_{min}Y$)) was measured by the color analyzer of TOPSCAN MODEL TC-1800MKII manufactured by Tokyo Denshoku Co. Then, a difference of $D_{min}(Y)$ between the stage of the initial processing solution and the stage after the running processing was defined as the generation of stain.

[EXPERIMENT 2: Processing stability]

After the running processing, processing was conducted for 5 hours, and sheets of color paper that had been exposed by means of wedge exposure were processed by 5 times, and the maximum reflected blue density ($D_{max}(Y)$) was measured by X-rite sold by Nippon Heiban Kizai Co. A difference between the maximum $D_{max}(Y)$ and the minimum $D_{min}(Y)$ was defined as the processing stability.

Circumstances in the color development processing tank in the process of running were evaluated in accordance with the following standard.

DEPOSITION o: No deposition. No problems are caused.

Δ: A small amount of deposition is found on the inner wall of the tank and the rack.

X: Deposition is found on almost all surfaces.

PRECIPITATION o: No precipitation. No problems are caused.

Δ: Precipitation is temporarily generated. X: Precipitation is generated at all times. Problems are caused in the circulation system.

TABLE 1

| Experiment No. | Solid processing agent for color development | Color development time | Capacity of CD tank (B) | Unit supply amount of color development solid processing agent (A) | A/B | Processing temperature of color development | Generation of stain | Stability of processing | Deposition | Precipitation | |
|---|---|---|---|---|---|---|---|---|---|---|---|
| 1-1 | Solid processing agent (1) | 22" | 12 l | 84 g | 7.0 | 39.8° C. | 0.063 | 0.15 | Δ | Δ | Comp. |
| 1-2 | | | | 52.5 g | 4.4 | | 0.055 | 0.05 | Δ | Δ | Comp. |
| 1-3 | | | | 31.5 g | 2.6 | | 0.054 | 0.03 | Δ | Δ | Comp. |
| 1-4 | | | | 10.5 g | 0.9 | | 0.050 | 0.03 | Δ | Δ | Comp. |
| 1-5 | Solid processing agent (2) | 18" | 12 l | 84 g | 7.0 | 40.5° C. | 0.035 | 0.20 | O | Δ | Inv. |
| 1-6 | | | | 52.5 g | 4.4 | | 0.020 | 0.07 | O | O | Inv. |
| 1-7 | | | | 31.5 g | 2.6 | | 0.017 | 0.03 | O | O | Inv. |
| 1-8 | | | | 10.5 g | 0.9 | | 0.017 | 0.02 | O | O | Inv. |
| 1-9 | Solid processing agent (2) | 10" | 12 l | 84 g | 7.0 | 42° C. | 0.030 | 0.25 | O | Δ | Inv. |
| 1-10 | | | | 52.5 g | 4.4 | | 0.018 | 0.07 | O | O | Inv. |
| 1-11 | | | | 31.5 g | 2.6 | | 0.015 | 0.03 | O | O | Inv. |
| 1-12 | | | | 10.5 g | 0.9 | | 0.015 | 0.03 | O | O | Inv. |
| 1-13 | Conventional solution replenishing system | 22" | 12 l | — | | | 0.070 | 0.10 | X | X | Comp. |

Comp.: Comparative example
Inv.: Present invention

As can be seen from Table 1, when color development processing is conducted in accordance with the present invention, even though the throughput in one operation is small, the generation of stain can be reduced. Besides, when a ratio of A/B is not more than 5, the processing stability can be improved more. In particular, it can be seen that it is more preferable that the ratio f A/B is not more than 3.

When the paraphenylenediamine color developing agent was changed from CD-3 to the chemical compounds (C-15), (C-17), (C-29) and (C-30) expressed by the formula [I] and the same experiment was carried out, the same result was provided.

[EXPERIMENT 2]

Figure 5:
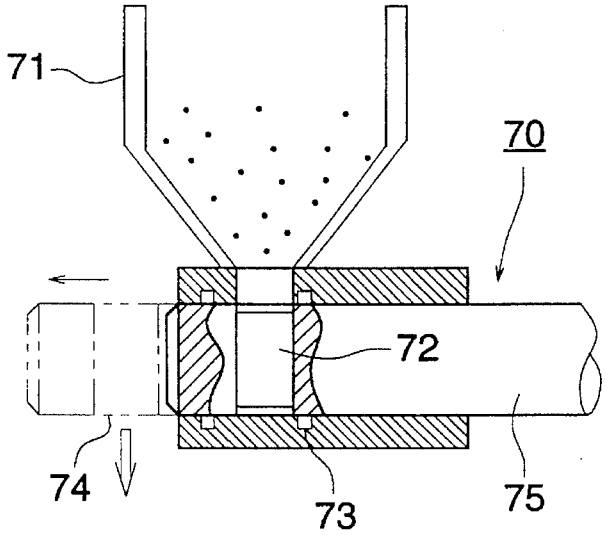
FIG. 5 is a sectional view of a granule processing agent supply unit.

FIG. 5 is a sectional view showing another supply device for supplying the solid processing agent. In this supply device, a granular type solid processing agent can be used. In this supply device 70, operation is carried out as follows. A granular type processing agent is charged into the hopper 71. According to the throughput of photosensitive material, the piston is moved horizontally (to the right), and a predetermined amount of granular processing agent is put into the measuring hole 72. Then the piston 75 is moved horizontally (to the left), so that the predetermined amount of granular processing agent is supplied to the filter tank from the discharge portion 74. This supply device was attached to the same automatic developing apparatus as that of Example 1 which was modified, and the same running test was carried out using the same granules, which were samples of solid processing agent before they were subjected to the tablet machine. As a result, the same excellent result as that of Example 1 was provided.

EXAMPLE 3

The supply device was changed as shown below. Other points were the same as those of Example 2, and the same experiment was carried out. In this experiment, the same result was provided.

Figure 6:
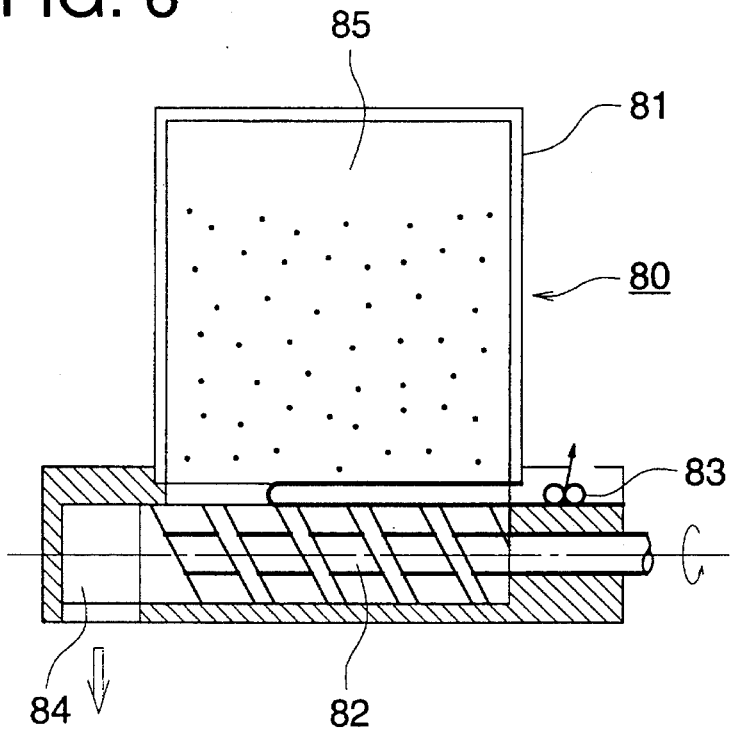
FIG. 6 is a sectional view of another granule processing agent supply unit.

FIG. 6 is a sectional view showing another supply device for supplying the solid processing agent shown in this example. The supply device 80 is provided with a package 81 charged with granular processing agent. The package 81 can be automatically opened and closed by the roller 83. When the rotational speed of the screw 82 is controlled, granular chemicals are supplied from the discharge section 84.

EXAMPLE 4

Figure 7:
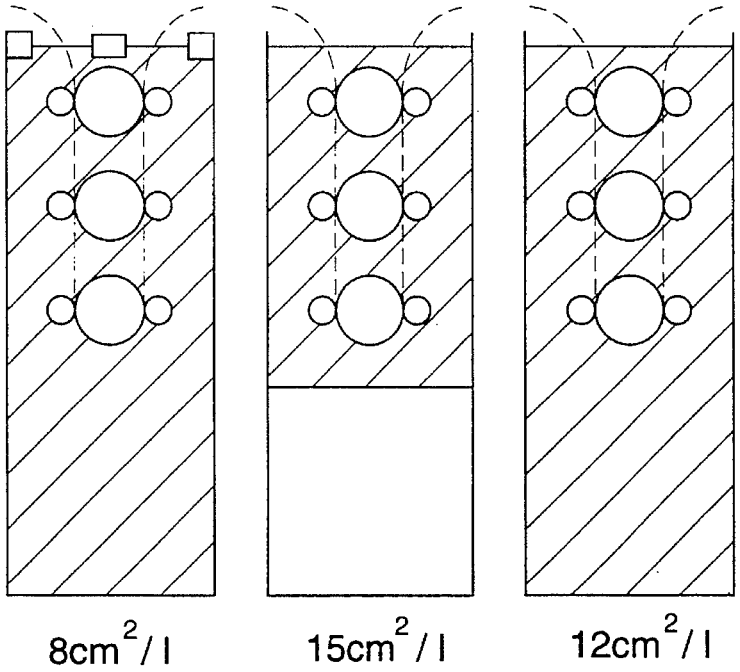
FIG. 7 is a schematic illustration showing variations of the color developing tank of Example 4.

In this example 4, the color developing tank 1A was replaced with another one as shown in FIG. 7, so that the opening area ratio N of the color developing tank could be changed. Other points were the same as those of Example 1, and the same experiment was carried out. The result of the experiment is shown on Table 2.

9 is a transverse sectional view showing the processing tanks from the color developing tank P3 to the first stabilizing tank of the automatic developing apparatus, wherein the view is taken in the conveyance direction. The processing tanks are arranged in the direction of conveyance of silver halide photosensitive material (photographic paper) P2. That is, the processing tanks are arranged in the order of the color developing tank P3, bleaching and fixing tank P4, first stabilizing tank P5, second stabilizing tank P6, and third stabilizing tank P7, which are arranged in the transverse direction. The color developing solution P3A, bleaching and fixing solution P4A, and stabilizing solutions P5A, P6A, P7A are respectively charged into the processing tanks. The conveyance passage of the photosensitive material P8 is shown by a one-dotted chain line, and the photosensitive material P2 is conveyed by the conveyance rollers PR1 to PR14 which are arranged in the conveyance direction from the entrance. Each processing tank is filled with the processing solution to the level PL which is the same with respect to all processing tanks.

Three processing tanks form one unit of processing tanks. Height of the unit of processing tanks is very small compared with the height of the conventional automatic developing apparatus. Incidentally, in FIG. 8, all processing tanks can be combined into one tank unit. The processing tanks are respectively covered with the upper conveyance guide P3B of the color developing tank P3, the upper conveyance guide P4B of the bleaching and fixing tank P4, the upper conveyance guide P5B of the first stabilizing tank P5, the upper conveyance guide P6B of the second stabilizing tank P6, and the upper conveyance guide P7B of the third stabilizing tank P7. Due to the upper conveyance guides, the opening areas of the processing tanks are remarkably reduced, and the tank capacities are also reduced. Due to the foregoing, the tank capacities of the color developing tank P3 and the bleaching and fixing tank P4 are respectively 5 l, and the tank capacities of the first, second and third stabilizing tanks P5, P6, P7 are respectively 4 l. Each tank is provided with the cover member P36 capable being opened and closed.

Figure 8:
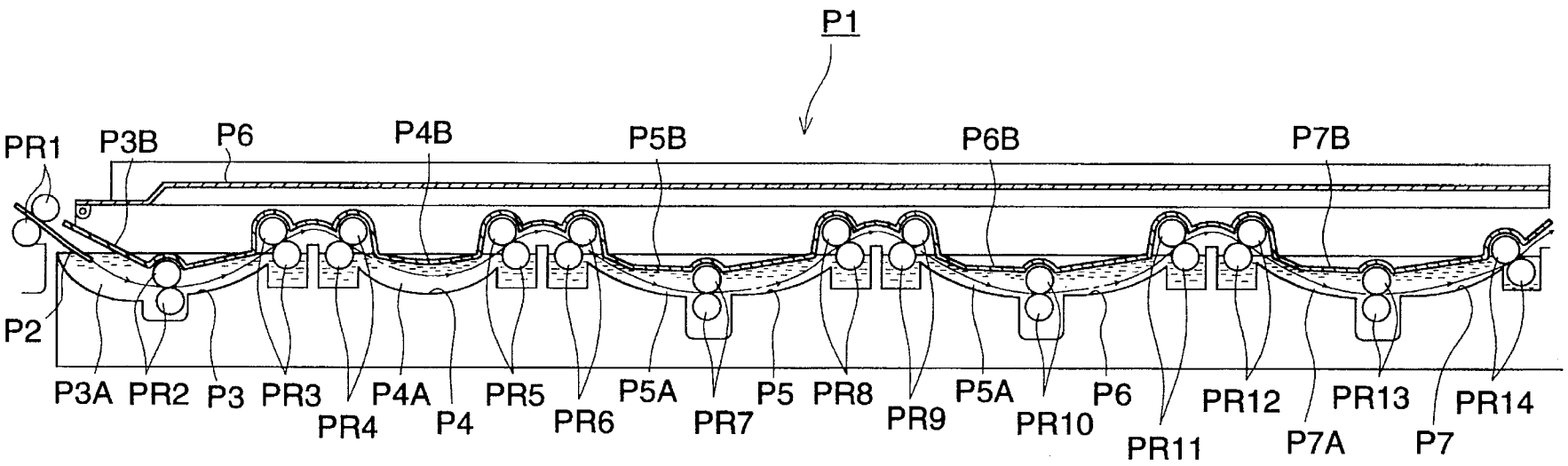
FIG. 8 is a transverse sectional view showing the automatic developing apparatus of Example 5.
Figure 9:
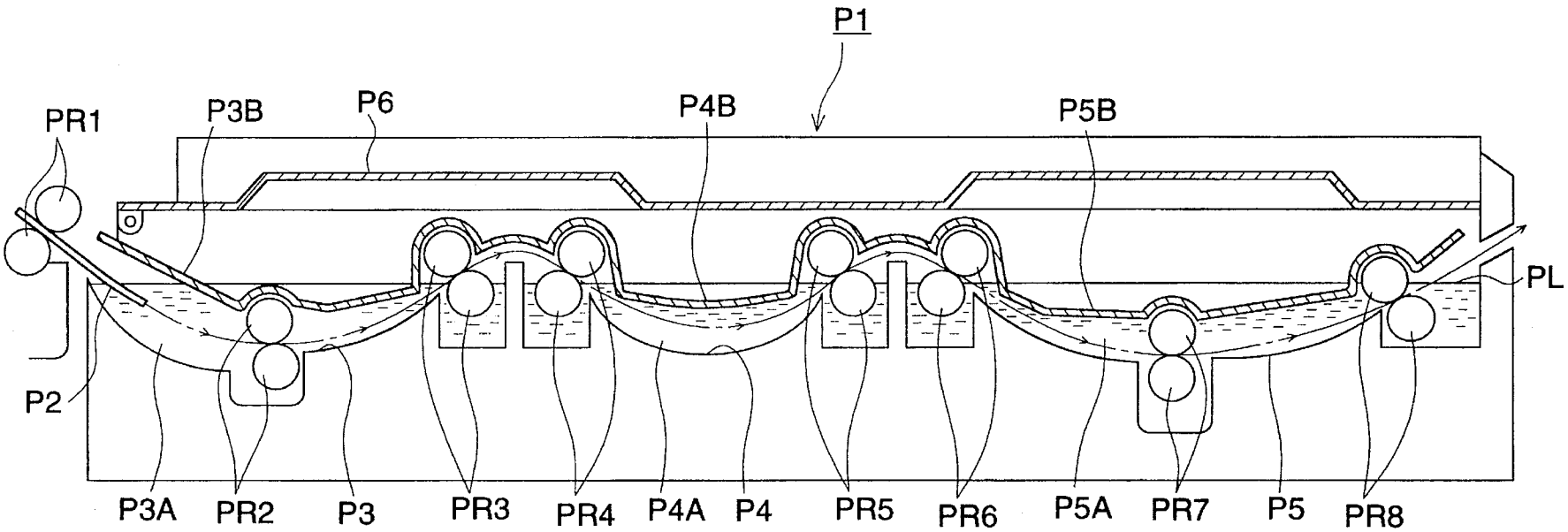
FIG. 9 is a transverse sectional view showing the tanks of the automatic developing apparatus from the color developing tank to the first stabilizing tank.

Although not shown in FIG. 8, in the automatic developing apparatus of the present invention, a current of processing solution perpendicular to the surface of the drawing is formed with respect to the conveyance passage. The

TABLE 2

| Experiment No. | Solid processing agent for color development | Color development time | Capacity of CD tank (B) | Unit supply amount (A) | A/B | Temp. | Ratio N of opening area | Generation of stain | Stability of processing | Deposition | Precipitation | |
|---|---|---|---|---|---|---|---|---|---|---|---|---|
| 4-1 | Solid processing agent (1) | 22" | 12 l | 10.5 g | 0.9 | 39.8° C. | 15 $cm^2/l$ | 0.068 | 0.05 | Δ | Δ | Comp. |
| 4-2 | Solid processing agent (2) | 10" | 12 l | 10.5 g | 0.9 | 42° C. | 15 | 0.030 | 0.05 | ○ | Δ | Inv. |
| 4-3 | Solid processing agent (2) | 10" | 12 l | 10.5 g | 0.9 | 42° C. | 12 | 0.015 | 0.03 | ○ | ○ | Inv. |
| 4-4 | Solid processing agent (2) | 10" | 12 l | 10.5 g | 0.9 | 42° C. | 8 | 0.013 | 0.03 | ○ | ○ | Inv. |
| 4-5 | Solid processing agent (2) | 10" | 12 l | 10.5 g | 0.9 | 42° C. | 6 | 0.011 | 0.03 | ○ | ○ | Inv. |

Comp.: Comparative example
Inv.: Present invention

As can be seen from Table 2, according to the present invention, an amount of generated stain was small. Especially when the opening area ratio N was reduced to be not more than 12 $cm^2/l$, an amount of generated stain was further reduced.

EXAMPLE 5

Figure 10:
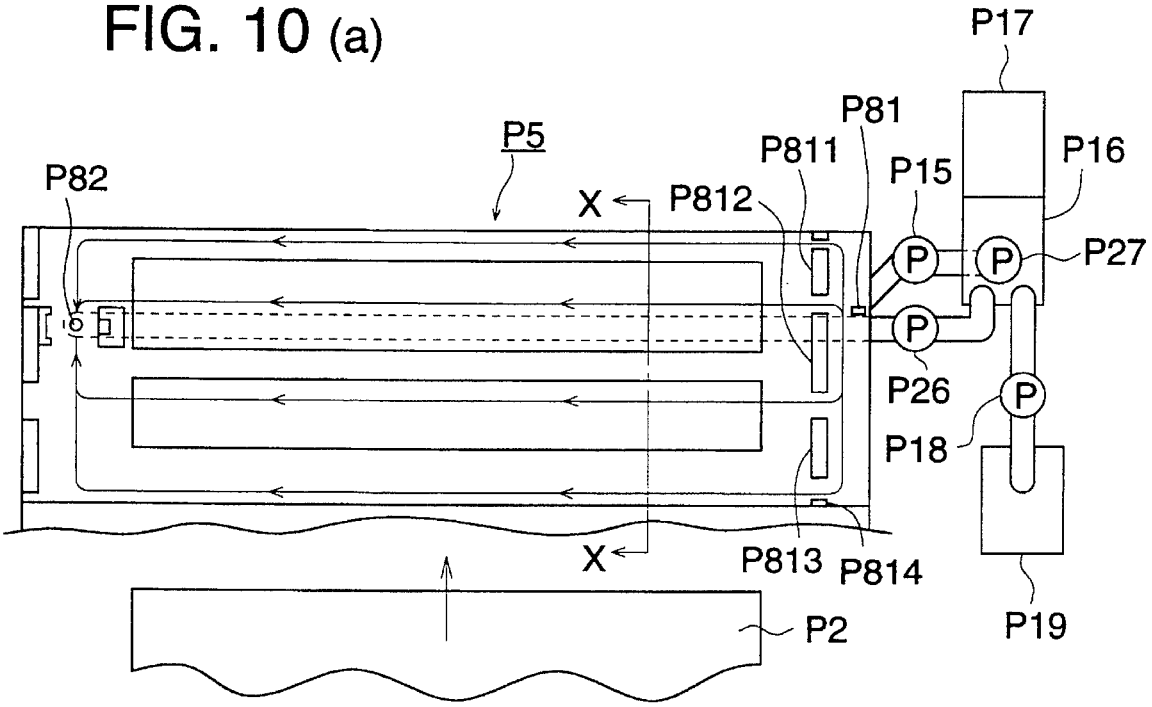
FIG. 10(*a*) is a view of the processing tank of the automatic developing apparatus, wherein the view is taken from an upper position of the processing tank, and FIGS. 10(*b*) and 10(*c*) are transverse sectional views of the processing tank.
Figure 10:
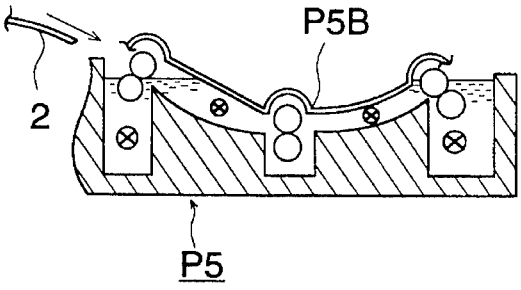
Figure 10:
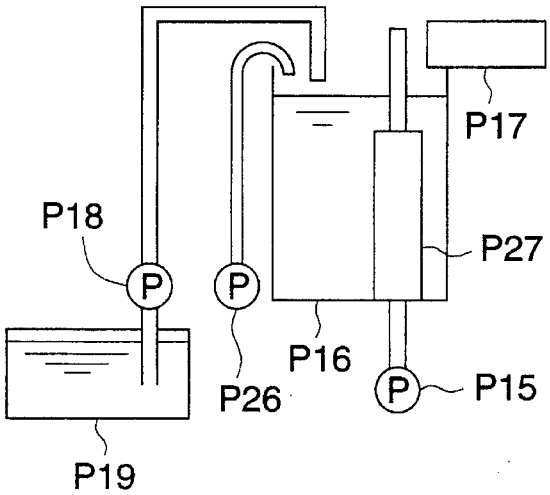

It should be noted that the reference numerals are different in this example from those of Examples 1 to 4. FIG. 8 is a transverse sectional view showing an outline of the arrangement of the automatic developing apparatus of this example, wherein the view is taken in the conveyance direction. FIG.

circumstances are illustrated in FIG. 10 which is a view showing the color developing tank P3 by way of example. FIG. 10(*a*) is a plan view of the color developing tank P3, and arrows in the view show the main current of the processing solution. The current of solution is formed by the pump P15 which is a circulation means. The color developing solution flows out from the outlet P81 of the pump P15. Then the processing solution passes through the openings P811, P812, P813 and P814, so that energetic currents are formed and flow from the right to the left in the drawing. Then the currents are sucked into the suction port P82 provided at the left end of the color developing tank P3. The suction port P82 is connected with the pump P26 so that the solution can be sucked. Then the processing solution sucked by the pump P26 passes through the pipe P26 and returns to the auxiliary tank P16. After that, the processing solution passes through the filter P27 for filtration and is returned to the processing tank by the pump P15. In this case, the solid processing agent is supplied to the auxiliary tank P16 by the solid processing agent supply means P17. Water is supplied by the pump P18 from the water tank P19 to the auxiliary tank P16.

FIG. 10(*b*) is a sectional view taken on line X—X in FIG. 10(*a*). As can be seen from FIG. 10(*b*), two rectangles illustrated at the center of FIG. 10(*a*) are the lower portions of the color developing tank P3. That is, the two rectangles are the inner wall surface of the color developing tank P3 which functions as a guide for guiding the photosensitive material P2. The currents flow out from the openings P11 to P14 in the transverse direction with respect to the conveyance direction of the photosensitive material P2, that is, the currents flow in the direction perpendicular to the surface of FIG. 10(*b*). That is, the currents of the processing solution are formed by the openings provided at the corresponding positions of FIG. 10(*b*). Accordingly, in the case of the color developing tank P23, in the conveyance passage of the photosensitive material P2, the currents generated in the processing tank region between the entry side conveyance roller R6 and the delivery side conveyance roller R8 provide the development facilitating effect.

The suction port P82 provided at the lower portion of the processing tank is connected with the circulation pump P26 through a pipe. The circulation pump P26 is connected with the auxiliary tank P16 through a pipe. The auxiliary tank P16 is connected with the circulation pump P15 through a pipe. The circulation pump P15 is connected with the outlet P18 of the processing tank through a pipe. The circulation pumps P26 and P15 continuously circulate the processing solution. The flow rate of each circulation pump can be continuously varied and controlled in a range from 3 l/min to 50 l/min. The processing tank is provided with an overflow port, and the overflowing solution is stored in the waste solution tank. The circulation pump P15 is controlled in accordance with the throughput of photosensitive material and the supply of the solid processing agent into the auxiliary tank. The processing tank is provided with a level gauge for detecting the level of the solution, and information of the detected level is transmitted to the control means. The circulation pump P26 is controlled in accordance with the level information and the control information of the circulation pump P15.

As shown in FIG. 10(*c*), the structure of the auxiliary tank P16 is the same as that of the auxiliary tank of Example 1 shown in FIG. 3. In the same manner as that of the auxiliary tank of Example 1 shown in FIG. 3, the auxiliary tank P16 is provided with the solid processing agent supply means P17. Therefore, in the auxiliary tank P16, water is replenished from the water tank P19 by the water supply pump P18, the processing solution temperature is adjusted by the heater and thermometer, the processing solution is subjected to filtration by the filter P21, and the solid processing agent is supplied into the processing solution by the solid processing agent supply means P17. In the same manner as that of the auxiliary tank of Example 1 shown in FIG. 3, there is provided a processing solution level sensor, and the detected level information is transmitted to the control means. Although not described in the control flow of FIG. 11, when the level of the processing solution is lower than a predetermined value, the processing is prohibited by the control means. It is preferable that the prohibition level is set at a position a little higher than the uppermost portion of the filter P27. A warning solution level is set at a position higher than the prohibition solution level, and it is preferable to give a warning when the solution level becomes lower than the warning solution level.

Water to be replenished to the auxiliary tank P16 is stored in a water tank P19. In the water tank P19, there is provided a temperature adjusting means composed of a heater and temperature sensor, so that the temperature is adjusted at a predetermined value. In the experiment described later, the temperature is adjusted in a range of 38°±1° C.

Figure 11:
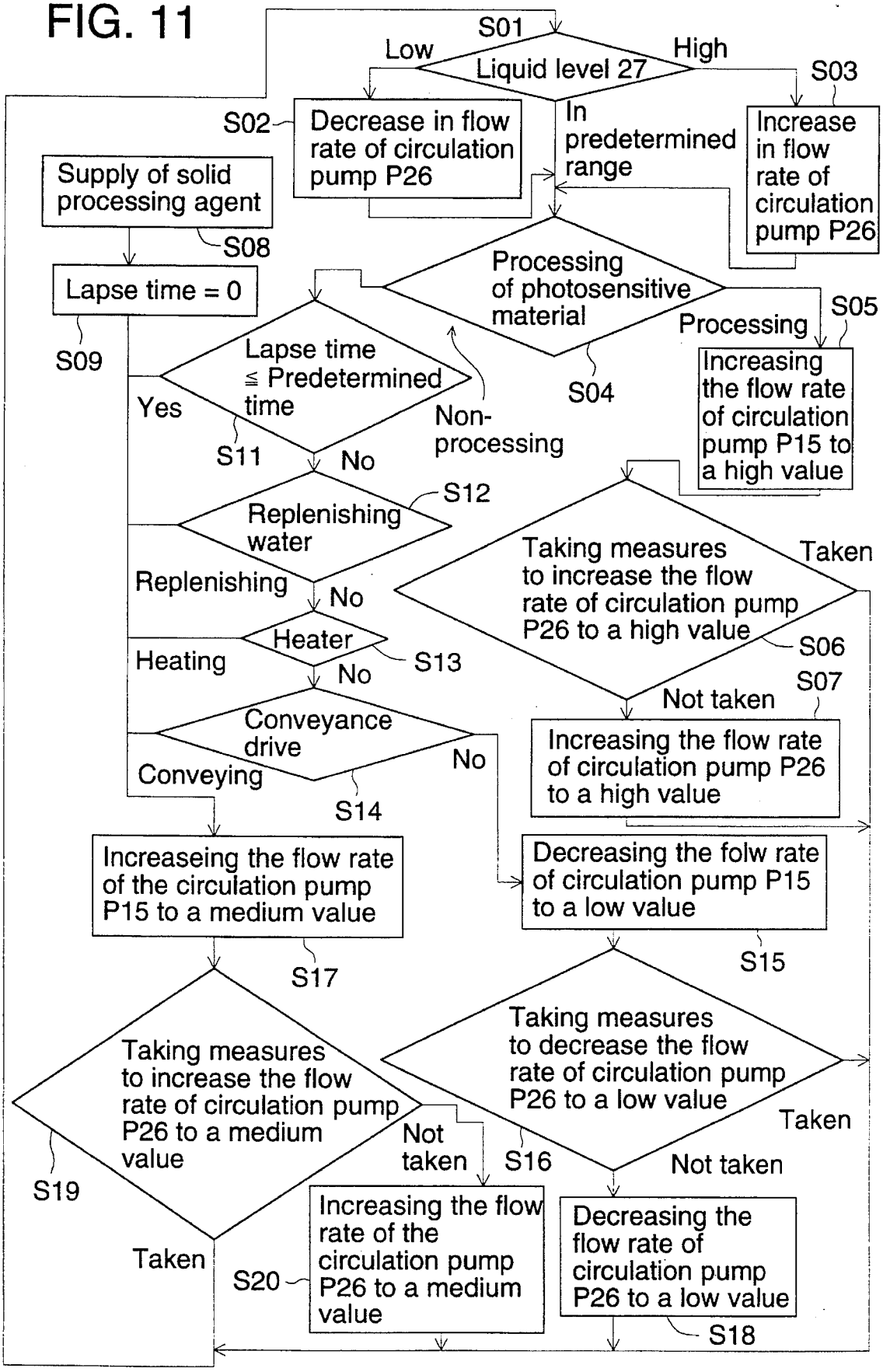
FIG. 11 is a control flow diagram showing the control flow of the processing solution circulation in the processing tank of the automatic developing apparatus of Example 5.

FIG. 11 is a control flow of the circulation system of this example. When the operational switch of the automatic developing apparatus is turned on, the circulation pumps P26 and P15 are driven under the condition that the flow rate is low. After that, the automatic developing apparatus control such as processing solution temperature control, photosensitive material conveyance control, processing agent replenishment control and water replenishment control is started. At this point of operation, all processing tanks are controlled under a common condition. When the common control is completed, each processing tank is controlled, and the program advances to step S01 in FIG. 11.

In step S01, the solution level in the processing tank detected by the solution level sensor is judged. When the solution level is in a predetermined range, the program advances to step S04. When the solution level is lower than the predetermined range in step S01, the program advances to step S02, and the flow rate of the circulation pump P26 is reduced by a predetermined ratio, and the program advances to step S04. When the solution level is higher than the predetermined range in step S01, the program advances to step S03, and the flow rate of the circulation pump P26 is increased by a predetermined ratio, and the program advances to step S04. In step S04, it is judged whether or not the photosensitive material is being processed. When the photosensitive material is not being processed in step S04, the program advances to step S11. When the photosensitive material is being processed in step S04, the program advances to step S05. While the photosensitive material is being processed, it is necessary to increase the flow rate of the processing solution jetted out from the slit. Therefore, the flow rate of the circulation pump P15 is increased to a predetermined high value, and the program advances to step S06. In step S06, it is judged whether or not the flow rate of the circulation pump P26 has already been increased. In the case where the flow rate of the circulation pump P26 has already been increased to the high value, the program returns to step S01. In the case where the flow rate of the circulation pump P26 has not been increased to the high value, the program advances to step S07, and the flow rate of the circulation pump P26 is increased to the predetermined high value, and the program returns to step SO1.

In this connection, when the program advances to step S11, it is judged whether or not a period of time that has passed from the supply of the solid processing agent conducted by the solid processing agent supply means P17 of the auxiliary tank P16 is shorter than the predetermined value. When the period of time is shorter than the predetermined value, the program advances to step S17, and the flow rate of the circulation pump P15 is made to a predetermined medium value, and the program advances to step S19. When the period of time is not shorter than the predetermined value, the program advances to step S12. In step S12, it is judged whether or not water is being replenished. When water is being replenished, the program advances to step S17, and the flow rate of the circulation pump P15 is made to be the predetermined medium value, and the program advances to step S19. When water is not being replenished, the program advances to step S13. In step S13, it is judged whether or not the heater in the auxiliary tank P16 is turned on. When the heater in the auxiliary tank P16 is turned on, the program advances to step S17, and the flow rate of the circulation pump P15 is made to be the predetermined medium value, and the program advances to step S19. When the heater in the auxiliary tank P16 is not turned on, the program advances to step S14. In step S14, it is judged whether or not the conveyance means for conveying the photosensitive material in the processing tank is operated. When the conveyance means is operated, the program advances to step S17, and the flow rate of the circulation pump P15 is made to be the predetermined medium value, and the program advances to step S19. When the conveyance means is not operated, the program advances to step S15. In step S15, the flow rate of the circulation pump P15 is made to be the predetermined medium value, and the program advances to step S16. In step S16, it is judged whether or not the flow rate of the circulation pump P26 has already been reduced to a low value. When the flow rate of the circulation pump P26 has already been reduced to a low value, the program returns to step SO1. When the flow rate of the circulation pump P26 has not been reduced to the low value, the program advances to step S18, and the flow rate of the circulation pump P26 is reduced to the predetermined low value, and the program returns to step SO1. In step S19, it is judged whether or not the flow rate of the circulation pump P26 has already been set to be the medium value. When the flow rate of the circulation pump P26 has already been set to be the medium value, the program returns to step SO1. When the flow rate of the circulation pump P26 has not been set to be the medium value, the program advances to step S20, and the flow rate of the circulation pump P26 is made to be the predetermined medium value, and the program returns to step S01.

When the solid processing agent is supplied by the solid processing agent supply means P16 at this time, an interruption handling is conducted on step S08, and the program advances to step S09, and a period of time that has passed is set at 0, that is, the timer is set at 0, and the program advances to step S17.

Due to the flow of control described above, only when the photosensitive material is processed, the processing solution is circulated at a high flow rate, so that the processing speed can be increased, and when the photosensitive material is not processed, the flow rate is made to be a low or medium value, so that oxidization and deterioration of the processing solution can be prevented unlike a case in which the processing solution is circulated at a high flow rate. When the processing solution is circulated at a low or medium flow rate, various problems caused when the processing solution is not circulated can be prevented, the detail of which will be described below. Unevenness of processing caused by a processing solution of high concentration close to a position where the solid processing agent is not dissolved can be prevented. Oxidization, deterioration and precipitation of the processing solution components can be prevented. Uneven temperature and defective control of temperature caused by local heating can be prevented. Uneven processing caused by the processing solution of low concentration in the case of replenishing water can be prevented. High concentration of the processing solution caused when replenishment water is not completely mixed can be prevented. When the conveyance rollers 51, 60, 73, 34, 33 are rotated at every predetermined time, in a preferable example, the conveyance rollers 51, 60, 73, 34, 33 are rotated for 30 seconds at every 10 minutes, so as to prevent the growth of the precipitation of the processing agent components, the precipitation can be sufficiently diffused.

In this connection, the above judgment is preferably conducted as follows. A flag is set up in accordance with the result of judgment conducted by another CPU, and the judgment is carried out in accordance with the result obtained when the flag is read. In this way, judgment is quickly carried out. In this case, the high flow rate is defined as a value in a range from 20 to 30 ml/min. The medium flow rate is defined as a value lower than the high flow rate and not less than 10 ml/min. The low flow rate is defined as a value in a range from 5 to 10 ml/min.

Control except for control of the circulation means will be described as follows.

Control of the solid processing agent is conducted as follows. The throughput of the photosensitive material is detected by the photosensitive throughput detection means provided at the entrance of the automatic developing apparatus. Each time the detected throughput reaches a multiple of the throughput of photosensitive material per one operation of the supply of the solid processing agent, a predetermined amount of solid processing agent is supplied.

Temperature adjustment is effected as follows. When the temperature detected by the thermometer arranged in the auxiliary tank P16 is lower than the range of [predetermined temperature–predetermined deviation], the heater arranged in the auxiliary tank P16 exerts its full capacity 100%. When the temperature detected by the thermometer arranged in the auxiliary tank P16 is higher than the range of [predetermined temperature–predetermined deviation] and not higher than the predetermined temperature, the heater arranged in the auxiliary tank P16 exerts the capacity of 95%. When the temperature is not less than the predetermined temperature, the heater is turned off, so that the temperature can be adjusted at the predetermined value. When the temperature is not more than [predetermined temperature–predetermined dangerous temperature], and also when the temperature is not less than [predetermined temperature+predetermined dangerous temperature], a warning is given, and it is controlled that the processing is prohibited. In this case, the predetermined dangerous temperature is higher than the predetermined temperature deviation.

Supply of replenishment water includes a dissolving water replenishment control and an evaporated water replenishment control. In the dissolving water replenishment control, each time the detected throughput reaches a multiple of the throughput of photosensitive material per one operation of the supply of replenishment water, a predetermined amount of replenishment water is supplied. In the evaporated water replenishment control, each time the detected throughput reaches a multiple of the throughput of photosensitive material per one operation of the supply of evaporated replenishment water, a predetermined amount of evaporated replenishment water is supplied. In this connection, the throughput of photosensitive material per one supply operation can be found by a predetermined unit amount per one supply operation and a replenishment water amount per 1 $m^2$ of processed photosensitive material.

The conveyance rollers 51, 60, 73, 34, 33 are rotated for 30 seconds at every 10 minutes so as to prevent the growth of the precipitation of the processing agent components, and the precipitation can be sufficiently diffused.

[EXPERIMENT ]

In this experiment, instead of the automatic developing apparatus of Example 1, the automatic developing apparatus of Example 5 was used, and tablets of solid processing agent were used. Further, the solid processing agent supply means shown in FIG. 3 was used. Concerning the color development processing agent, the solid processing agent (4) of Example 1 was used, and the unit supply amount of the solid processing agent was set at 2 g. Photographic paper described in Example 1, the silver chloride containing ratio of which was 99.5 mol %, was exposed to light according to the normal method. After that, the photographic paper was subjected to the following process. Other points were the same as those of Example 1. Under the above condition, the same experiment as that of Example 1 was made. The substantially same result as that of Example 1 was obtained.

means, jets the pressured processing solution from a hole, the diameter of which is 1.5 to 2.0 mm, at a jet angle of 45°.

Figure 12:
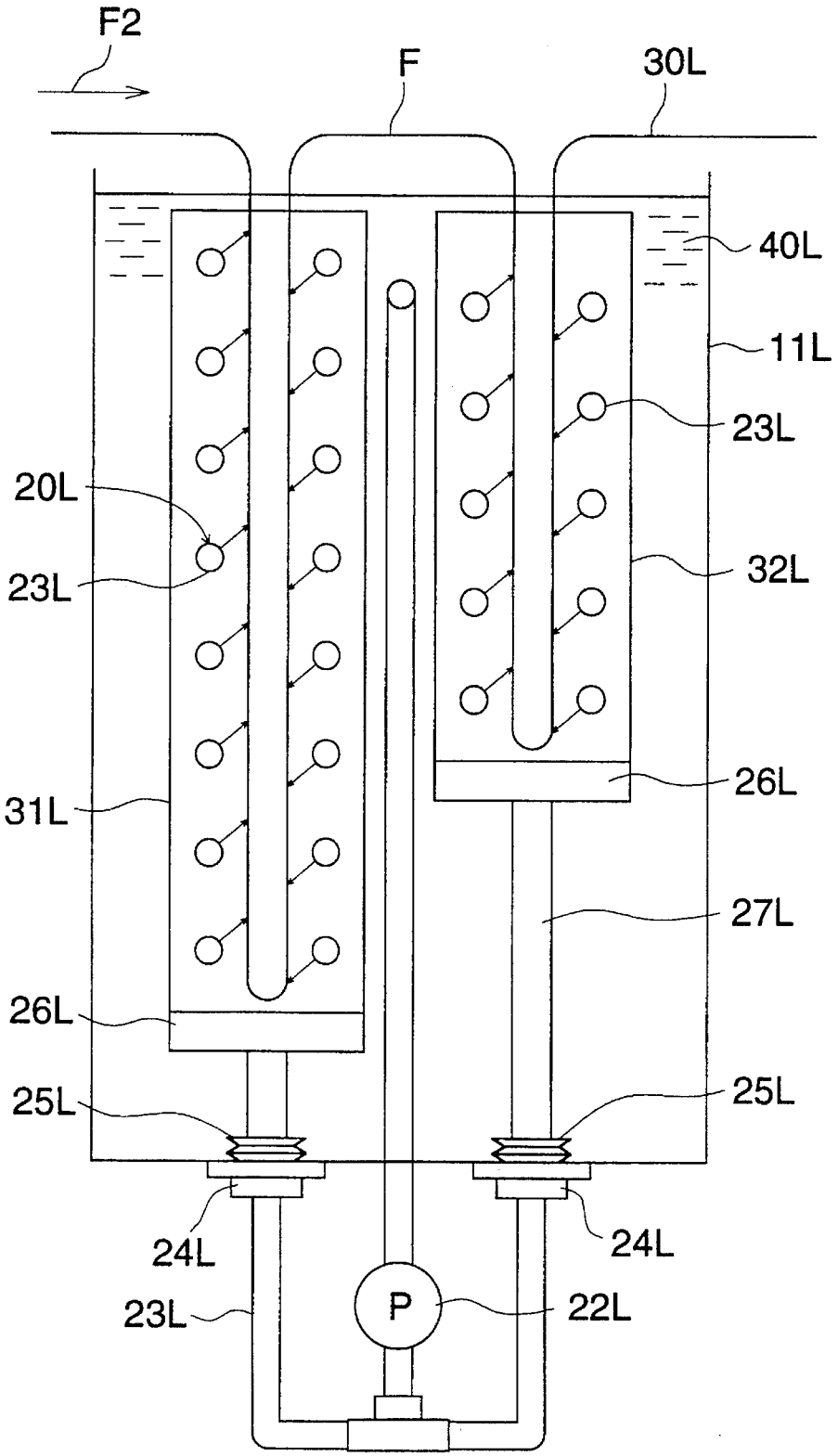
FIG. 12 is a sectional view of the primary portion of the color developing tank of the automatic developing apparatus of Example 6.
Figure 13:
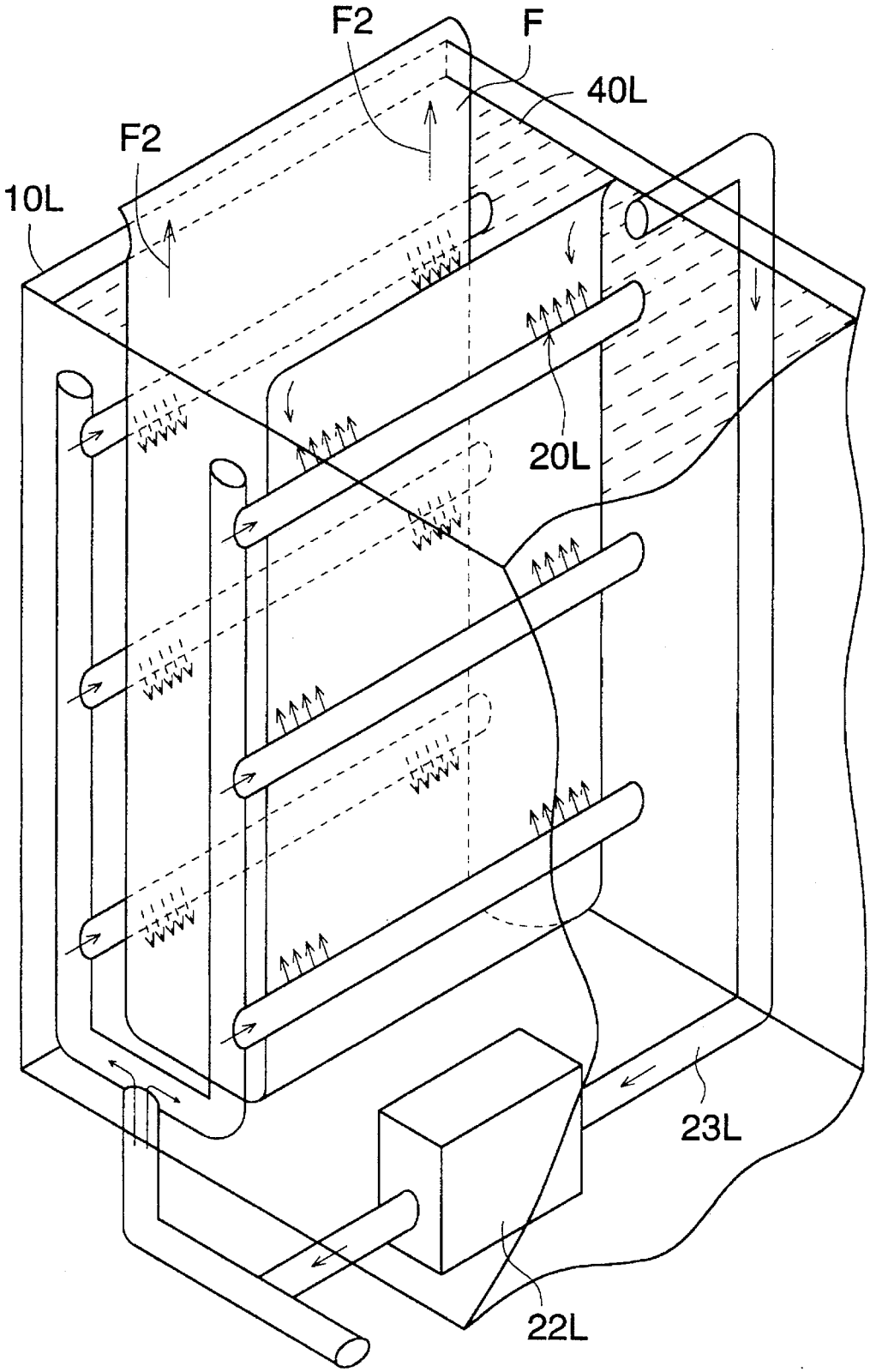
FIG. 13 is a perspective view of the color developing tank of the automatic developing apparatus of Example 6.

FIG. 13 is a perspective view of the second rack of the color developing agent. FIG. 13 is a view taken from a direction opposite to that of FIG. 12. As illustrated in the drawing, the jet angle of the nozzle 20L is 45° with respect to the photosensitive material conveyance direction F2.

Figure 14:
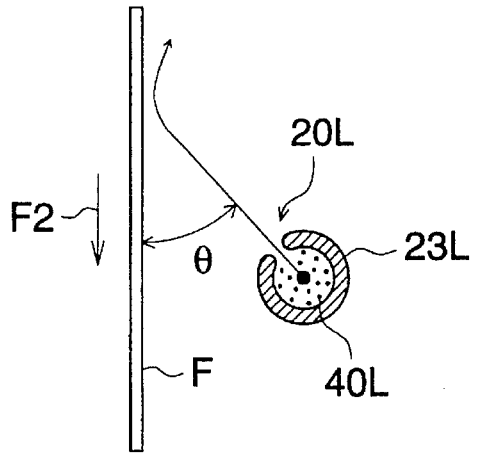
FIGS. 14(*a*) and 14(*b*) are illustrations of a spray of the color developing tank of the automatic developing apparatus of Example 6.
Figure 14:
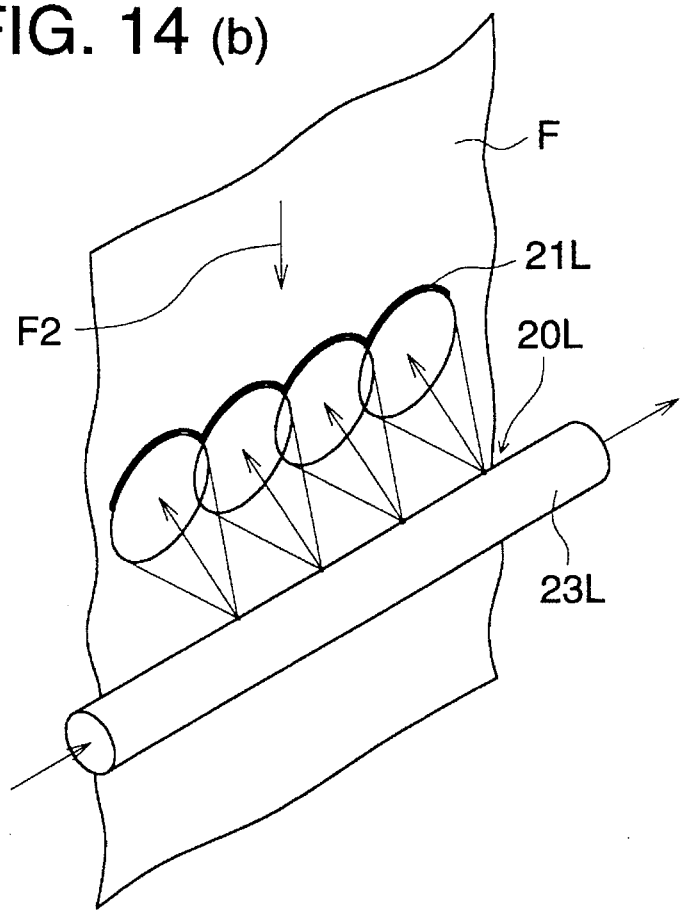

FIGS. 14(*a*) and 14(*b*) are schematic illustration for explaining the operation of the nozzle means. As illustrated in FIG. 14(*a*), a nozzle hole 20 is formed on the pipe 23L. The processing solution 40L is jetted out from the nozzle hole 20 onto the photosensitive material surface at the jet angle θ of 45°. When the processing solution in the processing tank is sucked by a pump and jetted out from the nozzle 20L through the pipe 23L as illustrated in FIG. 14(*b*), the processing solution adhering on the surface of photosensitive material F is blown out by the action of the composite speed of the photosensitive material conveyance speed and the jetting speed from the nozzle.

Figure 15:
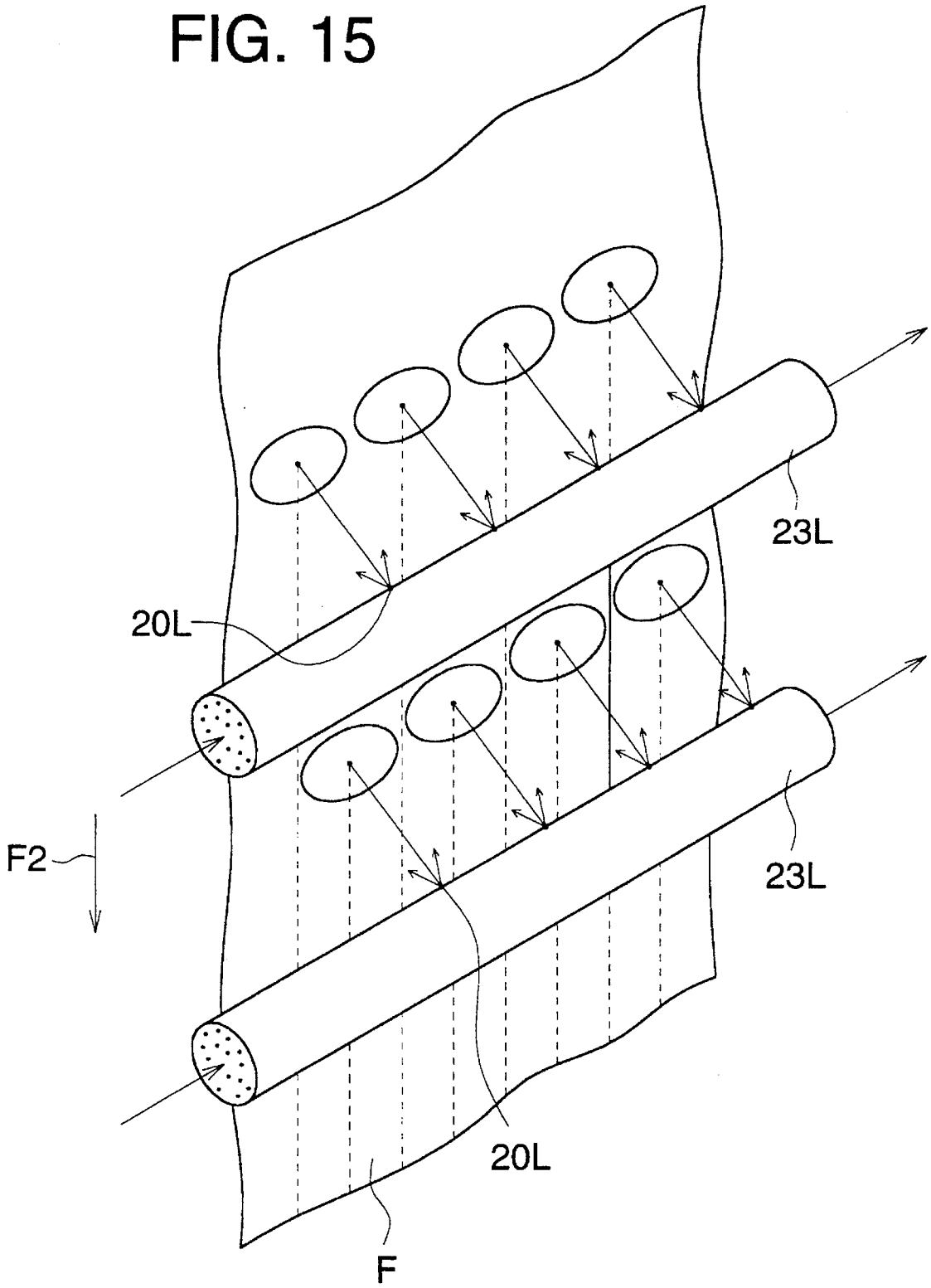
FIG. 15 is a perspective view of the arrangement of sprays in the color developing tank of the automatic developing apparatus of Example 6.

FIG. 15 is a perspective view of the nozzle means in which nozzles are arranged zigzag. As illustrated in the drawing, nozzles are arranged on the pipe 23L at regular intervals. Further, on the adjacent pipe 23L, nozzles are arranged at regular intervals, wherein these nozzles are shifted from the nozzles described before by a half pitch. Therefore, the entire nozzles are arranged zigzag.

| Process | Processing temperature | Processing time | Replenishment amount of solid processing agent | Amount of added replenishment water |
|---|---|---|---|---|
| Color development | 42.0 ± 0.2° C. | 10 seconds | 7.8 g/$m^2$ | 65 ml/$m^2$ |
| Bleaching fixing | 38.0 ± 0.5° C. | 10 seconds | 6.2 g/$m^2$ | 80 ml/$m^2$ |
| First stabilization | 38.0 ± 2.0° C. | 8 seconds | 1.0 g/$m^2$ | 180 ml/$m^2$ |
| Second stabilization | 38.0 ± 2.0° C. | 8 seconds | 1.0 g/$m^2$ | 180 ml/$m^2$ |
| Third stabilization | 38.0 ± 2.0° C. | 8 seconds | 1.0 g/$m^2$ | 180 ml/$m^2$ |
| Drying | 72.0 ± 5.0° C. | 30 seconds | — | — |

REMARK: The solid processing agent replenishment amount is a value per 1 $m^2$ of photographic paper.

EXAMPLE 6

In this example, the reference numerals are different from those of Examples 1 to 5. In the automatic developing apparatus of this example, the following units are attached to the color developing tank.

FIG. 12 is a sectional view of the primary portion of the color developing tank. As illustrated in the drawing, the color developing tank 11L is filled with the color developing solution. In the color developing tank 11L, there are provided a first rack 31L and a second rack 32L. In the conveyance passage 30L illustrated in the drawing, photosensitive material F is conveyed. The conveying means is a means for conveying the photosensitive material F in the above conveyance passage. In this case, the photosensitive material F is conveyed by conveyance rollers not shown in the drawing. The processing solution 40L is pressured by the plump 22L of the pump means. On the first rack, the processing solution, which has been pressured by the pump, passes through a flange joint 24L, bellows joint 25L and box joint 26L, and is connected to a pipe 23L to which nozzles are attached. On the second rack, the processing solution, which has been pressured by the pump, passes through a flange joint 24L, bellows joint 25L, extension pipe 27L and box joint 26L, and is connected to a pipe 23L to which nozzles are attached. In each row of the pipe 23L, 7 to 8 nozzle holes are formed. The nozzle 20L, which is a nozzle The operation of this example will be explained as follows. First, an exposed photosensitive material is set at the entry port. Then the photosensitive material is conveyed in the conveyance passage. Then the photosensitive material is sent onto the first rack, and the processing solution is jetted onto the photosensitive material from the nozzles. Then the photosensitive material is sent onto the second rack and subjected to color development in the same manner as described above. After that, the photosensitive material is sent into each processing tank so as to be processed in the tank. In this connection, the color development solution is sucked by the pump 22L and passes through the pipe. Then the color development solution is jetted onto the photosensitive material F on the first and second racks. Since the nozzles are inclined by a jetting angle θ with respect to the photosensitive material surface, the nozzles in the adjacent row on the same rack are not affected. In the case where a plurality of racks are provided, the nozzles in the adjacent rack are not affected. Accordingly, there is no possibility that the end portion F1 of the photosensitive material is excessively processed. Since the plurality of racks are provided, the agitation effect of the processing solution is enhanced. In this connection, it is preferable that the jet angle is form 0° to 90°.

In this example, the automatic developing apparatus is similar to that of Example 1, and the color developing tank of Example 1 is replaced with that shown in FIGS. 12 to 15 in this example. In this automatic developing apparatus, the capacity of each tank is 2 l. Concerning the color development processing agent, the solid processing agent (3) of Example 1 was used, and the unit supply amount of the solid processing agent was set at 5 g. Photographic paper described in Example 1, the silver chloride containing ratio of which was 99.5 mol %, was exposed to light according to the normal method. After that, the photographic paper was subjected to the following process. Other points were the same as those of Example 1. Under the above condition, the same experiment as that of Example 1 was made. The substantially same result as that of Example 1 was obtained.

| Process | Processing temperature | Processing time | Replenishment amount of solid processing agent | Amount of added replenishment water |
|---|---|---|---|---|
| Color development | 42.0 ± 0.2° C. | 10 seconds | 7.8 g/m$^2$ | 65 ml/m$^2$ |
| Bleaching fixing | 38.0 ± 0.5° C. | 10 seconds | 6.2 g/m$^2$ | 80 ml/m$^2$ |
| First stabilization | 38.0 ± 2.0° C. | 10 seconds | — | — |
| Second stabilization | 38.0 ± 2.0° C. | 10 seconds | — | — |
| Third stabilization | 38.0 ± 2.0° C. | 10 seconds | 1.0 g/m$^2$ | 180 ml/m$^2$ |
| Drying | 72.0 ± 5.0° C. | 50 seconds | — | — |

REMARK: The solid processing agent replenishment amount is a value per 1 m$^2$ of photographic paper.

EXAMPLE 7

In the automatic developing apparatus of Example 5, the solid processing agent for color development, color developing time, color developing tank capacity, amount of replenishment water for color development and ratio of the open area of the color developing tank were changed as shown on Table 3. In the running experiment, an amount of color paper processed by one operation was changed to 2.5 m$^2$. Other points were the same as those of Example 5.

The results of the experiment are shown on Table 3.

In this connection, the solid processing agent for color development shown on Table 3 is described as follows. The charge amount per one tablet is 2 g, the diameter is 17 mm, and the thickness is 6 mm, which are the same as those of the solid processing agent used in Operation (4) described in Example 1.

Figure 16:
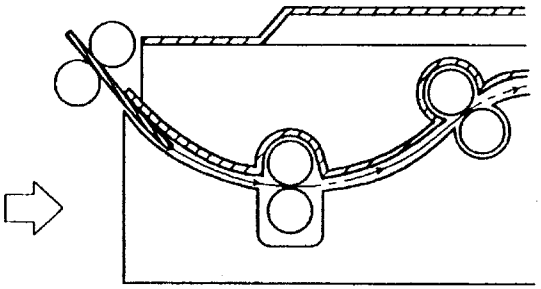
FIG. 16(A), 16(B) and 16(C) are sectional views of the tanks.
Figure 16:
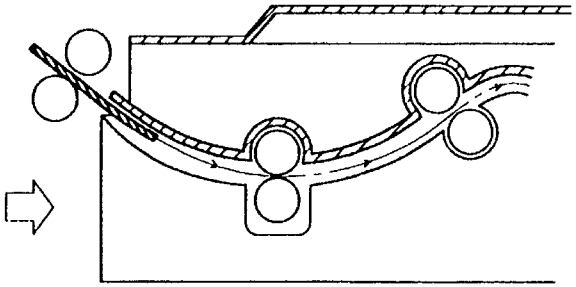
Figure 16:
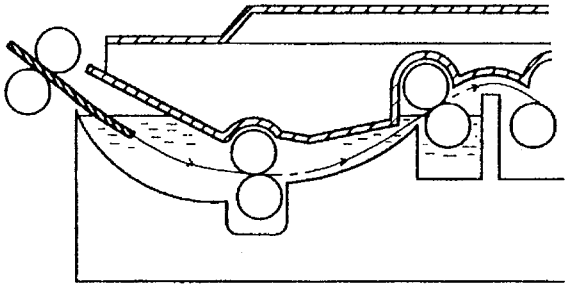

The capacity of the color developing tank was reduced in the following manner. As illustrated in FIGS. 16(A), 16(B) and 16(C), it is composed in such a manner that a portion of the inner wall of the processing tank is also used as the conveyance guide for conveying photosensitive material. In this way, the width of the photosensitive material conveyance passage was reduced in the order of FIG. 16(A), FIG. 16(B) and FIG. 16(C), so that the processing tank capacity was reduced.

TABLE 3

| Experiment No. | Solid processing agent for color development | Color development time | Capacity of CD tank (B) l | Replenishment water amount (C) l/m$^2$ | Area of conveyed photosensitive material (ST) m$^2$ | B/C | B/ST | Ratio of opening area (N) cm$^2$/l | Generation of stain | Stability of processing | Deposition | Precipitation | Remark |
|---|---|---|---|---|---|---|---|---|---|---|---|---|---|
| 7-1 | ⑤ | 22" | 8 | 0.065 | 0.07 | 123.1 | 114.3 | 8 | 0.078 | 0.20 | Δ | Δ | Comp. |
| 7-2 | ④ | 10" | 8 | 0.065 | 0.07 | 123.1 | 114.3 | 8 | 0.030 | 0.11 | ○ | ○ | Inv. |
| 7-3 | ④ | 10" | 6 | 0.065 | 0.07 | 92.3 | 85.7 | 8 | 0.018 | 0.06 | ○ | ○ | Inv. |
| 7-4 | ④ | 10" | 3 | 0.065 | 0.07 | 46.2 | 42.9 | 8 | 0.013 | 0.04 | ○ | ○ | Inv. |
| 7-5 | ④ | 10" | 1 | 0.065 | 0.07 | 15.4 | 14.3 | 8 | 0.011 | 0.03 | ○ | ○ | Inv. |

Comp.: Comparative example
Inv.: Present invention

As can be seen from Table 3, in the case of B/C<100, it is possible to further provide the same effect of the present invention as described before. Further, in the case of B/C<50, it is possible to provide more effect.

According to the present invention, even when the color developing time is short and the throughput is small, the occurrence of stain is reduced over a long period of time.

What is claimed is:

1. An apparatus for processing a silver halide color photographic material with a processing solution, comprising:

a color developing tank in which a color developing solution is stored, wherein a volume of a color developing solution in the color developing tank is B (l), and the photographic material is subjected to color development with the color developing solution;

an agent replenishing device for replenishing a solid agent for color development by a unit amount of A (g) at a time, substantially directly into the color developing tank, wherein a ratio of the unit amount A to the volume B satisfies the following relation: $0.01<A/B<5$;

a processing tank located next to the color developing tank, in the processing tank is stored a processing solution to process the photographic material subjected to the color development; and a conveyor to convey the photographic material into the color developing tank and into the processing tank, wherein the conveyor conveys the photographic material from starting dipping the photographic material in the color developing solution to starting dipping the photographic material in the processing solution for a time T which satisfies the following relationship: 5 seconds$\leqq T \leqq$18 seconds.

2. The apparatus of claim 1, further comprising a water replenishing device for replenishing water substantially directly into the color developing tank.

3. The apparatus of claim 2, wherein the water is heated.

4. The apparatus of claim 1, wherein the color developing tank has an opening area S ($cm^2$) which is an interface area between air and the color developing solution and a ratio N of the opening area S to the volume B is not more than 12 $cm^2/l$.

5. The apparatus of claim 1, wherein the color developing tank comprises a nozzle for jetting the color developing solution toward the photographic material.

6. The apparatus of claim 1, wherein an amount C (l) of water is replenished for dissolving the solid processing agent whose amount is necessary to process the photographic material of 1 ($m^2$) and a ratio of the volume B to the water amount C satisfies the following relation: $B/C<100$.

7. The apparatus of claim 1, wherein the conveyor conveys the photographic material along a passage and a sectional view of the color developing tank is shaped so as to follow along the passage of the photographic material.

8. The apparatus of claim 7, wherein the developing tank has a internal wall used as a guide member to guide the photographic material along the passage.

9. The apparatus of claim 1, further comprising circulating means for generating a circulation current of the color developing solution along a flow passage, wherein the circulating means regulates a flow rate of the circulation current in accordance with a working condition of the apparatus.

10. The apparatus of claim 9, further comprising a filter disposed on the flow passage so as to filtrate the color developing solution, and the agent replenishing device supplies the solid agent upstream of the filter in relation to the flow passage.

11. The apparatus of claim 1, further comprising circulating means for generating a circulation current of the color developing solution along a flow passage and a filter disposed on the flow passage so as to filter the color developing solution, wherein the circulating means comprises a first circulating means disposed on the flow passage from the color developing tank to the filter, and a second circulating means on the flow passage from the filter to the color developing tank.

12. The apparatus of claim 11, wherein the second circulating means generates a circulation current with a substantially constant flow rate while the photographic material is being processed in the color developing tank.

13. The apparatus of claim 11, wherein the color developing tank comprises a level sensor to detect the level of the color developing solution, and the first circulating means is controlled in accordance with the detected level.

14. The apparatus of claim 11, wherein the second circulating means regulates a flow rate of the circulation current in accordance with a working condition of the apparatus and the first circulating means is controlled in accordance with the working condition of the apparatus.

15. The apparatus of claim 11, wherein the color developing tank comprises a level sensor to detect the level of the color developing solution, and the first circulating means or the second circulating means is controlled in accordance with the detected level.

16. The apparatus of claim 1, wherein the ratio of A/B satisfies the following relation: $0.05<A/B\leqq 3$.

17. The apparatus of claim 1, wherein a ratio of B/ST satisfies the following relation: $1.5\leqq B/ST\leqq 100$, wherein B is a tank capacity (l) and ST is an area ($m^2$) of a photosensitive material conveying surface.

18. The apparatus of claim 17, wherein the ratio of B/ST satisfies the following relation: $3.0\leqq B/ST\leqq 50$.

19. The apparatus of claim 18, wherein the ratio of A/B satisfies the following relation: $0.05<A/B\leqq 3$.

* * * * *